US011214851B2

(12) United States Patent
Nyshadham et al.

(10) Patent No.: US 11,214,851 B2
(45) Date of Patent: Jan. 4, 2022

(54) SUPERALLOYS COMPOSITIONS INCLUDING AT LEAST ONE TERNARY INTERMETALLIC COMPOUND AND APPLICATIONS THEREOF

(71) Applicant: BRIGHAM YOUNG UNIVERSITY, Provo, UT (US)

(72) Inventors: Chandramouli Nyshadham, Provo, UT (US); Jacob E. Hansen, Rexburg, ID (US); Gus L. W. Hart, Provo, UT (US)

(73) Assignee: BRIGHAM YOUNG UNIVERSITY

( * ) Notice: Subject to any disclaimer, the term of this patent is extended or adjusted under 35 U.S.C. 154(b) by 267 days.

(21) Appl. No.: 15/765,952

(22) PCT Filed: Oct. 28, 2016

(86) PCT No.: PCT/US2016/059316
§ 371 (c)(1),
(2) Date: Apr. 4, 2018

(87) PCT Pub. No.: WO2017/123308
PCT Pub. Date: Jul. 20, 2017

(65) Prior Publication Data
US 2019/0112690 A1 Apr. 18, 2019

Related U.S. Application Data

(60) Provisional application No. 62/249,822, filed on Nov. 2, 2015.

(51) Int. Cl.
*C22C 19/03* (2006.01)
*C22C 19/07* (2006.01)
(Continued)

(52) U.S. Cl.
CPC ..... *C22C 19/03* (2013.01); *C22C 1/02* (2013.01); *C22C 19/00* (2013.01); *C22C 19/002* (2013.01);
(Continued)

(58) Field of Classification Search
None
See application file for complete search history.

(56) References Cited

U.S. PATENT DOCUMENTS 4,154,662 A 5/1979 Verger et al.

FOREIGN PATENT DOCUMENTS

JP 2012128912 A * 7/2012

OTHER PUBLICATIONS

Experimental Investigation of the Phase Equilibria in the Co—Nb—V Ternary System C.P. Wang, S. Yang, S.Y. Yang, D. Wang, J.J. Ruan, J. Li, and X.J. Liu Journal of Phase Equilibria and Diffusion vol. 36 No. 6 2015 (Year: 2015).*
(Continued)

*Primary Examiner* — Jenny R Wu
(74) *Attorney, Agent, or Firm* — Marcus S. Simon

(57) ABSTRACT

Embodiments disclosed herein related to superalloy compositions and applications using the same. The superalloy compositions disclosed herein including at least one ternary intermetallic compound having a general chemical composition of $A_Z[B_XC_Y]$. Base element A is selected from the group consisting of cobalt, iron, and nickel; and element B and element C are independently selected from different members of a group consisting 40 elements of the periodic table. Base element A, element B, and element C are each different elements. Z is about 2.1 to about 3.9. X and Y are about 0.1 to about 1.9. Additionally, the at least one ternary intermetallic compound of each of the superalloy compositions exhibits the face-centered cubic structure $L1_2$. The at
(Continued)

least one ternary intermetallic compound of each of the ternary superalloy compositions may exhibit a theoretical formation enthalpy and a decomposition energy less than $Co_3$[Al, W].

21 Claims, 13 Drawing Sheets

(51) Int. Cl.

| | |
|---|---|
| ***C22C 38/02*** | (2006.01) |
| ***C22C 38/00*** | (2006.01) |
| ***C22C 30/00*** | (2006.01) |
| ***C22C 1/02*** | (2006.01) |
| ***C22C 19/00*** | (2006.01) |
| ***C22C 38/06*** | (2006.01) |
| ***C22C 19/05*** | (2006.01) |

(52) U.S. Cl.
CPC ..... *C22C 19/005* (2013.01); *C22C 19/007* (2013.01); *C22C 19/05* (2013.01); *C22C 19/058* (2013.01); *C22C 19/07* (2013.01); *C22C 30/00* (2013.01); *C22C 38/00* (2013.01); *C22C 38/002* (2013.01); *C22C 38/02* (2013.01); *C22C 38/06* (2013.01)

(56) References Cited

OTHER PUBLICATIONS

Composition-dependent interdiffusivity matrices in face centered cubic Ni—Al—X (X = Rh and W) alloys at 1423, 1473 and 1523 K: A high throughput experimental measurement Juan Chen, Lijun Zhang (Year: 2018).*
Experimental determination of phase equilibria in the NieHfeSi ternary system C.P. Wang, J.F. Luo, J.J. Ruan, C.C. Zhao, S.Y. Yang, X.J. Liu (Year: 2013).*
Evaluation of the Thermodynamic Properties and Phase Equilibria of the Ordered γ' and Disordered γ Phases in the Ni—Al—Ta System Shihuai Zhou1, Long-Qing Chen1 (Year: 2003).*
Dislocation slip and twinning in Ni-based L12 type alloys J. Wang, H. Sehitoglu* (Year: 2014).*
Molecular Dynamics simulations of molten Ni-based superalloys Christopher Woodward (Year: 2012).*
Experimental Investigation and thermodynamics modeling of Co-Rich region in the Co—Al—Ni—W quaternary system J. ZHu (Year: 2014).*
Diffusivities and atomic mobilities in disordered fee and ordered Li1 Ni—Al—W alloy Chong Chen (Year: 2015).*
Transport and magnetic properties of Heusler alloy Ni—Mn—Sb prepared by solid state microwave heating Shi (Year: 2015).*
Enthalpy of mixing of liquid and undercooled liquid ternary and quaternary Cu—Ni—Si—Zr alloys VT. Witusiewicz*, I. Arpshofen, H.J. Seifert, F. Sommer, F. Aldinger (Year: 2002).*
A binomial truncation function proposed for the second-moment approximation of tight-binding potential and application in the ternary Ni—Hf—Ti system J H Li, X D Dai, T LWang and B X Liu1 (Year: 2007).*
Experimental Investigation of the Phase Equilibria in the Co—Nb—V Ternary System C.P. Wang, S. Yang, S.Y. Yang, D. Wang, J.J. Ruan, J. Li, and X.J. Liu (Year: 2015).*
K.P. Gupta The Ni—Ti—Zr System Journal of Phase Equilibria vol. 20 No. 4 (Year: 1999).*
Takayuki Taksugi Environmental effect on mechanical properties of recrystallized L12-type Ni3(Si, Ti) intermetallics Journal of Materials Science 26(1991) p. 1179-1186 (Year: 1991).*
International Search Report and Written Opinion for International Application No. PCT/US2016/059316 dated Jul. 6, 2017.
U.S. Appl. No. 62/249,822, filed Nov. 2, 2015.
Barber, et al., "The Quickhull Algorithm for Convex Hulls", ACM Transactions on Mathematical Software, vol. 22, No. 4, Dec. 1996, pp. 469-483.
Curtarolo, et al., "aflowlib. org: A distributed materials properties repository from high-throughput ab initio calculations", Computational Materials Science 58, 2012, pp. 227-235.
Curtarolo, et al., "The high-throughput highway to computatioal materials design", Nature Materials, 12.3, 2013, pp. 191-201.
Entel, et al., "Composition-Dependent Basics of Smart Heusler Materials from First-Principles Calculations", Materials Science Forum, 684:1-29 (doi:10.4028/www.scientific.neUMSF.684.1), 2011, p. 4, para 2.
Eurich et al., "Thermodynamic stability and electronic structure of eta-Ni6Nb(Al,Ti) from first principles", Scripta Materialia, 77:37-40 (doi: 10.1016/j.scriptamat.2014.01.012), 2014, p. 37, col. 1, para 1; col. 2, para 1 -2; p. 38, col. 1, para 1; p. 39, col. 1, para 3; col. 2, para 3; Figure 1 (c), 2.
Hansen, et al., "Machine Learning Predictions of Molecular Properties: Accurate Many-Body Potentials and Nonlocality in Chemical Space", The Journal of Physical Chemistry Letters, 6, 2015, pp. 2326-2331.
Hu, et al., "Review: Experimental enthalpies of formation of compounds in Al—Ni—X systems", J Mater Sci., 41(3):631-641 (doi: 10.1007/s10853-006-6479-x), 2006, p. 632, col. 2, para 3; p. 633, Table I; p. 634, col. 2, para 1; Table IV, V; p. 635, Table VII, VIII; p. 636, Table X; p. 637.
Kaufman, et al., "Calculation of superalloy phase diagrams: Part 111", Metallurgical Transactions A, vol. 6A, Nov. 1975, pp. 2115-2122.
Kresse, et al., "Efficient iterative schemes for ab initio total-energy calculations using a plane-wave basis set", Physical Review B, 30 54.16, 1996, p. 11169.
Kresse, et al., "From ultrasoft pseudopotentials to the projector augmented-wave method", Physical Review B, vol. 59, No. 3, Jan. 15, 1999, pp. 1758-1775.
Levy, et al., "Uncovering compounds by synergy of cluster expansion and high-throughput methods", Journal of the American Chemical Society, 132.13, 2010, pp. 4830-4833.
Monkhorst, et al., "Special points for Brillonin-zone integrations*", Physical Review B, vol. 13, No. 12, Jun. 15, 1976, pp. 5188-5192.
Murnaghan, et al., "The Compressibility of Media under Extreme Pressures", Proceedings of the National Academy of Sciences of the United States of America 30, 1944, 244247.
Pettifor, et al., "A chemical scale for crystal-structure maps", 25 Solid state communications 51.1, 1984, pp. 31-34.
Rao, et al., "Effect of Ternary Additions on the Room Temperature Lattice Parameter of Ni3Al", Phys. Stat. Sol. (A), 133(2):231-235 (doi 10.1002/pssa.2211330203), 1992, p. 234, para 2; p. 235, Fig 3.
Saal, et al., "Thermodynamic stability of CoAlWL12y", Acta Materialia, 61.7, 2013, pp. 2330-2338.
Sato, et al., "Cobalt-base high-temperature alloys", Science 312, 2006, pp. 90-91.
Soga, et al., "Phase relation and microstructure in multi-phase interrnetallic alloys based on Ni3Al—Ni3Nb—Ni3V pseudo-ternary alloy system", Intermetallics, 14(2):170-179 (doi:10.1016/J.intermet.2005.05.002), 2006, pp. 170-179.
Swenson, et al., "Phase equilibria in the Ga—In—Ni system at 600 degrees C", Journal of Phase Equilibria, vol. 16, Issue 6, Dec. 1995, pp. 508-515.
Taylor, et al., "A RESTful API for exchanging materials data in the aflowlib.org consortium", Computational Materials Science, 93:178-192 (doi: 10.1016/j.commatsci.2014.05.014), 2014, pp. 178-192.
Zunger, et al., "Special quasirandom structures", Physical Review Letters, 65.3, 1990, p. 353.

* cited by examiner

FIG. 3
FIG. 3A
FIG. 3B
FIG. 3C
FIG. 3D

| | Formation enthalpy (meV at T=0K) | Decomposition Energy (meV/atom at T=0K) | Density (g/cc at T=0K) | Bulk Modulus (GPa at T=0K) |
|---|---|---|---|---|
| $Co_3Al_{0.5}W_{0.5}$ | -127.244 | 66.288 | 10.2209 | 242.325 |
| $Co_3Cr_{0.5}Si_{0.5}$ | -134.585 | 26.984 | 8.59121 | 252.466 |
| $Co_3Hf_{0.5}Mo_{0.5}$ | -128.038 | 43.405 | 10.7916 | 227.904 |
| $Co_3Hf_{0.5}Nb_{0.5}$ | -188.440 | 45.996 | 10.5612 | 214.766 |
| $Co_3Hf_{0.5}Ta_{0.5}$ | -220.535 | 44.890 | 12.0469 | 219.408 |
| $Co_3Hf_{0.5}Ti_{0.5}$ | -212.090 | 61.652 | 9.98986 | 203.252 |
| $Co_3Hf_{0.5}V_{0.5}$ | -175.520 | 56.632 | 10.3345 | 218.045 |
| $Co_3Hf_{0.5}W_{0.5}$ | -153.436 | 34.112 | 12.294 | 235.489 |
| $Co_3Mo_{0.5}Si_{0.5}$ | -142.356 | 37.414 | 8.98748 | 251.971 |
| $Co_3Mo_{0.5}Ti_{0.5}$ | -147.952 | 6.022 | 9.0059 | 237.589 |
| $Co_3Nb_{0.5}Ta_{0.5}$ | -198.1 | 10.549 | 10.8404 | 238.78 |
| $Co_3Nb_{0.5}Ti_{0.5}$ | -205.326 | 11.641 | 8.80672 | 222.971 |
| $Co_3Nb_{0.5}V_{0.5}$ | -155.957 | 19.419 | 9.04852 | 238.201 |
| $Co_3Re_{0.5}Si_{0.5}$ | -136.304 | 36.405 | 10.7679 | 267.52 |
| $Co_3Re_{0.5}Ti_{0.5}$ | -142.083 | 4.830 | 10.6896 | 252.653 |
| $Co_3Si_{0.5}V_{0.5}$ | -219.329 | 21.149 | 8.43806 | 243.814 |
| $Co_3Si_{0.5}W_{0.5}$ | -163.456 | 32.419 | 10.5987 | 259.464 |
| $Co_3Ta_{0.5}Ti_{0.5}$ | -236.571 | 11.384 | 10.3401 | 228.029 |
| $Co_3Ta_{0.5}V_{0.5}$ | -188.525 | 17.840 | 10.6228 | 243.383 |
| $Co_3Ta_{0.5}W_{0.5}$ | -145.512 | 16.249 | 12.6333 | 259.738 |
| $Co_3Ti_{0.5}V_{0.5}$ | -208.142 | 6.54 | 8.45511 | 228.093 |
| $Co_3Ti_{0.5}W_{0.5}$ | -172.662 | 0 | 10.5571 | 245.374 |
| $Fe_3Al_{0.5}Ga_{0.5}$ | -167.667 | 0.244 | 7.34477 | 216.784 |
| $Fe_3Al_{0.5}Si_{0.5}$ | -229.029 | 29.996 | 6.89358 | Not Calculated |
| $Fe_3Be_{0.5}Si_{0.5}$ | -156.319 | 55.364 | 6.9499 | Not Calculated |
| $Fe_3Ga_{0.5}Si_{0.5}$ | -199.604 | 28.270 | 7.59058 | Not Calculated |
| $Fe_3Ta_{0.5}Ti_{0.5}$ | -157.959 | 36.114 | 9.31167 | Not Calculated |
| $Ni2Al_{0.50.5}Rh_{0.5}$ | -188.594 | 49.259 | 8.71272 | 196.931 |
| $Ni_3Al_{0.5}Be_{0.5}$ | -277.252 | 55.529 | 7.56336 | 184.769 |
| $Ni_3Al_{0.5}Co_{0.5}$ | -197.559 | 25.034 | 8.23468 | 196.037 |
| $Ni_3Al_{0.5}Cr_{0.5}$ | -208.867 | 18.467 | 8.08024 | 201.303 |
| $Ni_3Al_{0.5}Cu_{0.5}$ | -178.556 | 38.443 | 8.28018 | 182.495 |
| $Ni_3Al_{0.5}Ga_{0.5}$ | -354.604 | 7.855 | 8.23674 | 180.304 |
| $Ni_3Al_{0.5}Hf_{0.5}$ | -474.882 | 13.344 | 9.57774 | 178.839 |
| $Ni_3Al_{0.5}In_{0.5}$ | -223.678 | 41.287 | 8.44573 | 166.14 |
| $Ni_3Al_{0.5}Ir_{0.5}$ | -199.358 | 37.03 | 10.2836 | 209.535 |
| $Ni_3Al_{0.5}Li_{0.5}$ | -188.291 | 43.049 | 7.27348 | 157.551 |
| $Ni_3Al_{0.5}Mn_{0.5}$ | -270.692 | 4.148 | 8.02115 | 201.002 |
| $Ni_3Al_{0.5}Mo_{0.5}$ | -238.614 | 27.458 | 8.49251 | 204.96 |
| $Ni_3Al_{0.5}Nb_{0.5}$ | -390.649 | 0 | 8.3412 | 195.133 |
| $Ni_3Al_{0.5}Pt_{0.5}$ | -233.49 | 36.482 | 10.2186 | 197.383 |
| $Ni_3Al_{0.5}Ru_{0.5}$ | -155.003 | 61.235 | 8.65585 | 204.006 |

FIG. 3A

| | Formation enthalpy (meV at T=0K) | Decomposition Energy (meV/atom at T=0K) | Density (g/cc at T=0K) | Bulk Modulus (GPa at T=0K) |
|---|---|---|---|---|
| $Ni_3Al_{0.5}Sb_{0.5}$ | -331.74 | 0 | 8.61213 | 174.491 |
| $Ni_3Al_{0.5}Sc_{0.5}$ | -407.242 | 12.408 | 7.35561 | 162.247 |
| $Ni_3Al_{0.5}Si_{0.5}$ | -440.742 | 5.001 | 7.71222 | 195.773 |
| $Ni_3Al_{0.5}Sn_{0.5}$ | -298.845 | 16.564 | 8.5429 | 172.142 |
| $Ni_3Al_{0.5}Ta_{0.5}$ | -426.816 | 0 | 9.86915 | 200.826 |
| $Ni_3Al_{0.5}Tc_{0.5}$ | -185.752 | 48.572 | 8.61212 | 206.621 |
| $Ni_3Al_{0.5}Ti_{0.5}$ | -466.539 | 0 | 7.75336 | 186.022 |
| $Ni_3Al_{0.5}V_{0.5}$ | -364.871 | 0 | 7.97692 | 198.282 |
| $Ni_3Al_{0.5}W_{0.5}$ | -254.276 | 19.615 | 10.0327 | 213.158 |
| $Ni_3Al_{0.5}Zn_{0.5}$ | -260.518 | 19.492 | 8.1649 | 176.55 |
| $Ni_3Al_{0.5}Zr_{0.5}$ | -426.52 | 20.952 | 7.94706 | 173.486 |
| $Ni_3Au_{0.5}Ta_{0.5}$ | -141.737 | 45.591 | 12.1789 | 197.631 |
| $Ni_3Be_{0.5}Fe_{0.5}$ | -129.183 | 40.020 | 8.20716 | 206.390 |
| $Ni_3Be_{0.5}Ga_{0.5}$ | -203.282 | 59.482 | 8.3328 | 184.210 |
| $Ni_3Be_{0.5}Mn_{0.5}$ | -131.803 | 43.342 | 8.12368 | Not Calculated |
| $Ni_3Be_{0.5}Nb_{0.5}$ | -237.469 | 37.509 | 8.38966 | 198.450 |
| $Ni_3Be_{0.5}Sb_{0.5}$ | -159.051 | 58.747 | 8.70659 | 176.768 |
| $Ni_3Be_{0.5}Si_{0.5}$ | -298.122 | 47.926 | 7.78084 | 201.241 |
| $Ni_3Be_{0.5}Ta_{0.5}$ | -268.886 | 33.827 | 10.0242 | 204.090 |
| $Ni_3Be_{0.5}Ti_{0.5}$ | -308.349 | 53.044 | 7.78937 | 188.784 |
| $Ni_3Be_{0.5}V_{0.5}$ | -225.924 | 21.176 | 8.07324 | 202.995 |
| $Ni_3Be_{0.5}W_{0.5}$ | -144.245 | 44.590 | 10.2246 | 219.014 |
| $Ni_3Cd_{0.5}Ta_{0.5}$ | -154.544 | 35.501 | 10.6291 | 182.830 |
| $Ni_3Co_{0.5}Ga_{0.5}$ | -127.628 | 24.949 | 8.95304 | 195.26 |
| $Ni_3Co_{0.5}Sc_{0.5}$ | -165.935 | 55.270 | 8.04399 | 195.465 |
| $Ni_3Cr_{0.5}Ga_{0.5}$ | -137.139 | 20.179 | 8.82859 | 200.068 |
| $Ni_3Cr_{0.5}Hf_{0.5}$ | -241.337 | 41.747 | 10.0294 | 193.168 |
| $Ni_3Cr_{0.5}Nb_{0.5}$ | -131.984 | 37.121 | 8.71229 | 207.052 |
| $Ni_3Cr_{0.5}Sc_{0.5}$ | -172.522 | 49.594 | 7.92824 | 179.99 |
| $Ni_3Cr_{0.5}Si_{0.5}$ | -178.83 | 61.772 | 8.28527 | 214.896 |
| $Ni_3Cr_{0.5}Ta_{0.5}$ | -165.311 | 30.798 | 10.2343 | 212.632 |
| $Ni_3Cr_{0.5}Ti_{0.5}$ | -233.167 | 22.779 | 8.21484 | 201.616 |
| $Ni_3Cr_{0.5}Zr_{0.5}$ | -192.617 | 60.239 | 8.41671 | 187.816 |
| $Ni_3Cu_{0.5}Nb_{0.5}$ | -140.801 | 18.761 | 9.04079 | 194.438 |
| $Ni_3Cu_{0.5}Si_{0.5}$ | -188.901 | 41.366 | 8.4983 | 197.335 |
| $Ni_3Cu_{0.5}Ta_{0.5}$ | -170.998 | 16.926 | 10.6004 | 199.911 |
| $Ni_3Cu_{0.5}Ti_{0.5}$ | -203.745 | 41.866 | 8.46499 | 185.379 |
| $Ni_3Fe_{0.5}Ga_{0.5}$ | -188.068 | 6.215 | 8.82838 | 199.044 |
| $Ni_3Fe_{0.5}Hf_{0.5}$ | -270.157 | 49.892 | 10.1219 | 192.658 |
| $Ni_3Fe_{0.5}Nb_{0.5}$ | -165.361 | 40.283 | 8.86635 | 208.206 |
| $Ni_3Fe_{0.5}Sc_{0.5}$ | -227.272 | 24.202 | 7.91867 | 177.585 |
| $Ni_3Fe_{0.5}Ta_{0.5}$ | -198.343 | 33.573 | 10.3936 | 213.988 |
| $Ni_3Fe_{0.5}Ti_{0.5}$ | -264.457 | 28.454 | 8.31127 | 201.472 |
| $Ni_3Fe_{0.5}V_{0.5}$ | -144.675 | 27.872 | 8.55289 | 213.771 |

FIG. 3B

| | Formation enthalpy (meV at T=0K) | Decomposition Energy (meV/atom at T=0K) | Density (g/cc at T=0K) | Bulk Modulus (GPa at T=0K) |
|---|---|---|---|---|
| $Ni_3Fe_{0.5}Zr_{0.5}$ | -223.446 | 58.072 | 8.50381 | 187.294 |
| $Ni_3Ga_{0.5}Ir_{0.5}$ | -128.969 | 26.062 | 10.9994 | 208.550 |
| $Ni_3Ga_{0.5}Mo_{0.5}$ | -169.039 | 27.016 | 9.1854 | 203.748 |
| $Ni_3Ga_{0.5}Nb_{0.5}$ | -319.154 | 0 | 9.00659 | 193.808 |
| $Ni_3Ga_{0.5}Pt_{0.5}$ | -164.173 | 20 | 10.901 | 196.188 |
| $Ni_3Ga_{0.5}Sb_{0.5}$ | -264.116 | 0 | 9.27306 | 173.119 |
| $Ni_3Ga_{0.5}Sc_{0.5}$ | -339.517 | 10.116 | 8.03941 | 161.236 |
| $Ni_3Ga_{0.5}Si_{0.5}$ | -369.04 | 6.687 | 8.47193 | 194.794 |
| $Ni_3Ga_{0.5}Sn_{0.5}$ | -229.319 | 16.074 | 9.2144 | 170.923 |
| $Ni_3Ga_{0.5}Ta_{0.5}$ | -354.694 | 0 | 10.5266 | 199.153 |
| $Ni_3Ga_{0.5}Ti_{0.5}$ | -393.791 | 0 | 8.44457 | 184.432 |
| $Ni_3Ga_{0.5}V_{0.5}$ | -292.293 | 0 | 8.73243 | 196.845 |
| $Ni_3Ga_{0.5}W_{0.5}$ | -185.070 | 18.805 | 10.7101 | 211.453 |
| $Ni_3Ga_{0.5}Zn_{0.5}$ | -188.412 | 21.582 | 8.88587 | 175.286 |
| $Ni_3Hf_{0.5}Mn_{0.5}$ | -292.559 | 38.031 | 10.0586 | 193.31 |
| $Ni_3Hf_{0.5}Sb_{0.5}$ | -357.732 | 15.511 | 10.496 | 171.923 |
| $Ni_3Hf_{0.5}Sc_{0.5}$ | -475.091 | 0.309 | 9.36582 | 162.210 |
| $Ni_3Hf_{0.5}Si_{0.5}$ | -459.248 | 42.245 | 9.82647 | 191.522 |
| $Ni_3Hf_{0.5}Sn_{0.5}$ | -361.812 | 9.347 | 10.4577 | 171.349 |
| $Ni_3Hf_{0.5}Sn_{0.5}$ | -361.812 | 9.347 | 10.4577 | 171.349 |
| $Ni_3Hf_{0.5}Ti_{0.5}$ | -484.237 | 32.601 | 9.74496 | 183.306 |
| $Ni_3Hf_{0.5}Zn_{0.5}$ | -305.763 | 29.997 | 10.1933 | 173.286 |
| $Ni_3Hf_{0.5}Zr_{0.5}$ | -463.368 | 39.854 | 9.87263 | 173.32 |
| $Ni_3In_{0.5}Sb_{0.5}$ | -153.537 | 0 | 9.45137 | 160.743 |
| $Ni_3In_{0.5}Si_{0.5}$ | -230.216 | 48.017 | 8.6474 | 178.959 |
| $Ni_3In_{0.5}Ta_{0.5}$ | -246.121 | 0.000 | 10.6452 | 186.112 |
| $Ni_3In_{0.5}V_{0.5}$ | -165.344 | 13.940 | 8.91417 | 181.875 |
| $Ni_3Ir_{0.5}Si_{0.5}$ | -183.666 | 55.211 | 10.5383 | 222.990 |
| $Ni_3Li_{0.5}Nb_{0.5}$ | -158.408 | 14.277 | 8.05053 | 171.546 |
| $Ni_3Li_{0.5}Si_{0.5}$ | -212.612 | 39.95 | 7.48012 | 172.794 |
| $Ni_3Li_{0.5}Ta_{0.5}$ | -189.101 | 9.855 | 9.64266 | 176.937 |
| $Ni_3Li_{0.5}Ti_{0.5}$ | -214.741 | 45.211 | 7.49537 | 161.311 |
| $Ni_3Li_{0.5}V_{0.5}$ | -135.351 | 6.094 | 7.75026 | 174.310 |
| $Ni_3Mn_{0.5}Nb_{0.5}$ | -204.998 | 11.187 | 8.76003 | 208.215 |
| $Ni_3Mn_{0.5}Sb_{0.5}$ | -151.450 | 8.407 | 9.05927 | 190.453 |
| $Ni_3Mn_{0.5}Sc_{0.5}$ | -238.653 | 23.361 | 7.85318 | 179.833 |
| $Ni_3Mn_{0.5}Si_{0.5}$ | -271.182 | 16.926 | 8.22392 | 215.414 |
| $Ni_3Mn_{0.5}Sn_{0.5}$ | -132.092 | 25.682 | 8.99057 | 189.881 |
| $Ni_3Mn_{0.5}Ta_{0.5}$ | -237.445 | 5.012 | 10.3104 | 213.645 |
| $Ni_3Mn_{0.5}Ti_{0.5}$ | -283.787 | 19.665 | 8.2522 | Not Calculated |
| $Ni_3Mn_{0.5}V_{0.5}$ | -177.297 | 5.791 | 8.43819 | 213.514 |
| $Ni_3Mn_{0.5}Zr_{0.5}$ | -244.989 | 44.847 | 8.4461 | 188.017 |
| $Ni_3Mo_{0.5}Sc_{0.5}$ | -210.949 | 42.297 | 8.31587 | 184.966 |
| $Ni_3Nb_{0.5}Pd_{0.5}$ | -129.445 | 51.506 | 9.38779 | 196.643 |

FIG. 3C

| | Formation enthalpy (meV at T=0K) | Decomposition Energy (meV/atom at T=0K) | Density (g/cc at T=0K) | Bulk Modulus (GPa at T=0K) |
|---|---|---|---|---|
| $Ni_3Nb_{0.5}Pt_{0.5}$ | -171.759 | 47.674 | 10.8874 | 207.720 |
| $Ni_3Nb_{0.5}Sb_{0.5}$ | -223.915 | 34.923 | 9.28636 | 184.314 |
| $Ni_3Nb_{0.5}Sc_{0.5}$ | -369.167 | 0.000 | 8.12831 | 177.046 |
| $Ni_3Nb_{0.5}Si_{0.5}$ | -336.158 | 50.93 | 8.47905 | 206.842 |
| $Ni_3Nb_{0.5}Sn_{0.5}$ | -235.196 | 21.558 | 9.27917 | 184.769 |
| $Ni_3Nb_{0.5}Zn_{0.5}$ | -241.060 | 0.000 | 8.94507 | 189.984 |
| $Ni_3Pd_{0.5}Ta_{0.5}$ | -159.912 | 51.477 | 10.9176 | 201.781 |
| $Ni_3Pt_{0.5}Si_{0.5}$ | -228.456 | 39.001 | 10.46 | 210.931 |
| $Ni_3Pt_{0.5}Ta_{0.5}$ | -202.070 | 44.830 | 12.3641 | 212.831 |
| $Ni_3Pt_{0.5}Ti_{0.5}$ | -249.816 | 57.533 | 10.3782 | 199.408 |
| $Ni_3Pt_{0.5}V_{0.5}$ | -139.802 | 35.217 | 10.649 | 210.977 |
| $Ni_3Sb_{0.5}Sc_{0.5}$ | -319.968 | 47.442 | 8.42994 | 157.544 |
| $Ni_3Sb_{0.5}Si_{0.5}$ | -309.861 | 20.899 | 8.81999 | 186.752 |
| $Ni_3Sb_{0.5}Sn_{0.5}$ | -206.917 | 0 | 9.53845 | 165.709 |
| $Ni_3Sb_{0.5}Ta_{0.5}$ | -256.534 | 28.575 | 10.7292 | 189.515 |
| $Ni_3Sb_{0.5}Ti_{0.5}$ | -335.301 | 10.804 | 8.71924 | 177.094 |
| $Ni_3Sb_{0.5}V_{0.5}$ | -189.466 | 37.794 | 8.99878 | 185.842 |
| $Ni_3Sb_{0.5}Zn_{0.5}$ | -167.565 | 0 | 9.21249 | 169.292 |
| $Ni_3Sb_{0.5}Zr_{0.5}$ | -311.554 | 29.495 | 8.98685 | 167.082 |
| $Ni_3Sc_{0.5}Si_{0.5}$ | -411.209 | 26.482 | 7.55594 | 175.494 |
| $Ni_3Sc_{0.5}Sn_{0.5}$ | -296.979 | 17.298 | 8.36935 | 155.681 |
| $Ni_3Sc_{0.5}Ta_{0.5}$ | -404.010 | 0.000 | 9.60462 | 182.784 |
| $Ni_3Sc_{0.5}Ti_{0.5}$ | -449.114 | 0.000 | 7.59095 | 167.289 |
| $Ni_3Sc_{0.5}V_{0.5}$ | -330.273 | 0.000 | 7.80405 | 177.980 |
| $Ni_3Sc_{0.5}W_{0.5}$ | -216.633 | 49.651 | 9.78283 | 192.709 |
| $Ni_3Sc_{0.5}Zn_{0.5}$ | -241.036 | 39.296 | 7.97161 | 156.989 |
| $Ni_3Sc_{0.5}Zr_{0.5}$ | -431.508 | 9.548 | 7.77988 | 157.553 |
| $Ni_3Si_{0.5}Sn_{0.5}$ | -302.991 | 25.686 | 8.76265 | 185.291 |
| $Ni_3Si_{0.5}Ta_{0.5}$ | -370.469 | 42.891 | 10.0539 | 212.270 |
| $Ni_3Si_{0.5}Ti_{0.5}$ | -459.821 | 14.534 | 7.93009 | 199.669 |
| $Ni_3Si_{0.5}V_{0.5}$ | -325.265 | 28.726 | 8.1702 | 211.057 |
| $Ni_3Si_{0.5}Zn_{0.5}$ | -276.329 | 16.949 | 8.38624 | 190.822 |
| $Ni_3Si_{0.5}Zr_{0.5}$ | -408.248 | 56.984 | 8.17123 | 185.65 |
| $Ni_3Sn_{0.5}Ta_{0.5}$ | -269.636 | 13.390 | 10.7252 | 190.168 |
| $Ni_3Sn_{0.5}Ti_{0.5}$ | -336.667 | 7.354 | 8.73542 | 176.524 |
| $Ni_3Sn_{0.5}V_{0.5}$ | -197.056 | 26.601 | 8.97675 | 186.147 |
| $Ni_3Sn_{0.5}Zn_{0.5}$ | -133.452 | 29.492 | 9.13553 | 167.105 |
| $Ni_3Sn_{0.5}Zr_{0.5}$ | -315.546 | 20.989 | 8.96555 | 166.583 |
| $Ni_3Ta_{0.5}Zn_{0.5}$ | -273.664 | 0.000 | 10.4925 | 195.348 |
| $Ni_3Ti_{0.5}V_{0.5}$ | -303.719 | 65.616 | 8.16358 | 198.578 |
| $Ni_3Ti_{0.5}Zn_{0.5}$ | -299.828 | 8.794 | 8.38655 | 180.504 |
| $Ni_3Ti_{0.5}Zr_{0.5}$ | -433.669 | 42.415 | 8.17515 | 178.021 |
| $Ni_3V_{0.5}Zn_{0.5}$ | -213.366 | 0.000 | 8.66292 | 193.352 |
| $Ni_3W_{0.5}Zn_{0.5}$ | -147.305 | 0.000 | 10.6985 | 209.736 |
| $Ni_3Zn_{0.5}Zr_{0.5}$ | -261.184 | 48.150 | 8.6138 | 168.005 |

*FIG. 3D*

SUPERALLOYS COMPOSITIONS INCLUDING AT LEAST ONE TERNARY INTERMETALLIC COMPOUND AND APPLICATIONS THEREOF

CROSS-REFERENCE TO RELATED APPLICATIONS

This application claims priority to U.S. Provisional Application No. 62/249,822 filed on Nov. 2, 2015, the disclosure of which is incorporated herein, in its entirety, by this reference.

STATEMENT OF GOVERNMENT INTEREST

This invention was made with government support under Grant No. ONR-N000141310635 awarded by the Office of Naval Research. The government has certain rights in the invention.

BACKGROUND

At least the crystal structure and stoichiometry of elements constituting a material must to be known to perform material computational techniques. Once the crystal structure and the stoichiometry of the elements are known, the material computational techniques can be performed using calculations and/or searching a repository on a large scale. The material computational techniques can be used to identify materials having selected characteristics.

Huge experimental database of known materials have been developed over the last century. An emerging area in materials science is computational prediction of new materials using a high-throughput approach in which hundreds of thousands of hypothetical candidates can be explored much faster than by experimental means. The high-throughput approach is disclosed in more detail in Curtarolo, Stefano, et al. "The high-throughput highway to computational materials design." Nature materials 12.3 (2013): 191-201, the disclosure of which is incorporated herein, in its entirety, by this reference. Over the past few decades, exploiting the power of supercomputers and advanced electronic structure methods, scientists are creating huge theoretical data repositories for the discovery of novel materials. The information from the experimental databases and theoretical data repositories can be used to discover new materials. For example, simple searches through the experimental databases and theoretical data repositories can identify new phases.

Data mining the experimental databases and theoretical data repositories and material informatics approaches can be used to identify structure or property relationships, which may suggest atomic combinations, stoichiometries, or structures of materials not included in the database. Using the experimental databases and theoretical data repositories for model building and machine learning can use the experimental databases and theoretical data repositories to predict materials that the experimental databases and theoretical data repositories do not contains. Model building is disclosed in more detail in Levy Ohad et al. "Uncovering compounds by synergy of cluster expansion and high-throughput methods," Journal of the American Chemical Society 132.13 (2010) 4830-4833, the disclosure of which is incorporated herein, in its entirety, by this reference. Machine learning is disclosed in more detail in Hansen, Katja, et al. "Machine Learning Predictions of Molecular Properties: Accurate Many-Body Potentials and Nonlocality in Chemical Space." The journal of physical chemistry letters 6.12 (2015): 2326-2331, the disclosure of which is incorporated herein, in its entirety, by this reference.

Superalloys are compositionally complex, containing multiple alloying elements. The extraordinary mechanical properties of superalloys at high temperatures make them useful for many important applications in aerospace and power industries. One of the basic traits of superalloys is that they generally occur in face-centered-cubic structure. The most common base elements for superalloys include at least one of nickel, cobalt, or iron. Generally, commercially available superalloys are nickel based. In "Cobalt-base high-temperature alloys," Science 312 (2006) 90-91 by Sato et al., a new cobalt (Co) based superalloy, $Co_3$[Al, W] was experimentally-identified and was found to have better mechanical properties than many nickel-based superalloys. This created an interest in the scientific community to search for other cobalt-based superalloys.

The $Co_3$[Al, W] superalloy has a face-centered-cubic structure called $L1_2$. $Co_3$[Al, W] is observed to be unstable at 1173 K. A theoretical investigation of the $Co_3$[Al, W] was carried out by Saal et al. The theoretical investigation by Saal et al. is disclosed in Saal et al. "Thermodynamic stability of $CoAlWL12_{\gamma'}$." Acta Materialia 61.7 (2013): 2330-2338, the disclosure of which is incorporated herein, it is entirety, by this reference. They used a special quasi-random structure (SQS) to mimic the properties of the $Co_3$[Al, W] at high temperatures. Saal et al., performed the density functional theory calculations using an SQS-32 structure that included the high temperature contributions occurring in the lattice such as electronic, phononic and magnetic excitation along with contributions of vacancy defects. Their results showed that $L1_2Co_3[Al_{0.5}, W_{0.5}]$ exhibits a decomposition energy (e.g., distance to the convex hull) of 66 meV/atom at a temperature of 0K (e.g., T=0K) and is metastable. They showed that the high temperature contributions make the phase thermodynamically more competitive with the decomposition energy at elevated temperatures. Their results concerning the stability justified their assumption of SQS-32 as a good theoretical model to correlate the properties of the $Co_3$[Al, W] superalloy.

SUMMARY

Embodiments disclosed herein are directed to superalloy compositions and applications using the same. The superalloy compositions disclosed herein include at least one ternary intermetallic compound having a general chemical composition of $A_Z[B_XC_Y]$. Base element A is selected from the group consisting of cobalt, iron, and nickel; and element B and element C are independently selected from different members of the group consisting of lithium, strontium, calcium, yttrium, scandium, zirconium, hafnium, titanium, niobium, tantalum, vanadium, molybdenum, tungsten, chromium, technetium, rhenium, manganese, iron, ruthenium, osmium, cobalt, iridium, rhodium, nickel, platinum, palladium, gold, silver, copper, magnesium, mercury, cadmium, zinc, beryllium, thallium, indium, aluminum, gallium, tin, silicon, and antimony. Base element A, element B, and element C are each different elements. Z is about 2.1 to about 3.9. X and Y are from about 0.1 to about 1.9. Additionally, the at least one ternary intermetallic compound of each of the superalloys exhibits the face-centered cubic structure $L1_2$. The at least one ternary intermetallic compound of each of the superalloys exhibits a theoretical formation enthalpy (meV) and decomposition energy (meV/atom at T=0K) less than $Co_3$[Al, W]. In particular, the at least one ternary intermetallic compound of each of the superalloys exhibits a theoretical formation enthalpy less than −127 meV at T=0K and a decomposition energy less than 66 meV/atom at T=0K.

In an embodiment, a superalloy composition is disclosed. The superalloy includes at least one ternary intermetallic compound exhibiting a decomposition energy that is less than 66 meV/atom at T=0K and a formation enthalpy that is less than −127 meV at T=0K. The at least one ternary intermetallic compound has chemical formula of $A_Z[B_XC_Y]$. Base element A is selected from the group consisting of iron, cobalt, and nickel. Element B and an element C are independently selected from different members of the group consisting of lithium, strontium, calcium, yttrium, scandium, zirconium, hafnium, titanium, niobium, tantalum, vanadium, molybdenum, tungsten, chromium, technetium, rhenium, manganese, iron, ruthenium, osmium, cobalt, iridium, rhodium, nickel, platinum, palladium, gold, silver, copper, magnesium, mercury, cadmium, zinc, beryllium, thallium, indium, aluminum, gallium, tin, silicon, and antimony. Z is about 2.1 to about 3.9. X and Y are each about 0.1 to about 1.9.

In an embodiment, a superalloy composition is disclosed. The superalloy composition includes one or more phases. At least one of the one or more phases includes at least one ternary intermetallic compound that is selected from the group consisting of $Co_Z[Nb_XV_Y]$, $Co_Z[Re_XTi_Y]$, $Co_Z[Ta_XV_Y]$, $Fe_Z[Ga_XSi_Y]$, $Ni_Z[Al_XRh_Y]$, $Ni_Z[Au_XTa_Y]$, $Ni_Z[Be_XFe_Y]$, $Ni_Z[Be_XGa_Y]$, $Ni_Z[Be_XMn_Y]$, $Ni_Z[Be_XNb_Y]$, $Ni_Z[Be_XSb_Y]$, $Ni_Z[Be_XSi_Y]$, $Ni_Z[Be_XTa_Y]$, $Ni_Z[Be_XTi_Y]$, $Ni_Z[Be_XV_Y]$, $Ni_Z[Be_XW_Y]$, $Ni_Z[Co_XSc_Y]$, $Ni_Z[Ga_XIr_Y]$, $Ni_Z[Hf_XSi_Y]$, $Ni_Z[In_XV_Y]$, $Ni_Z[Ir_XSi_Y]$, $Ni_Z[Mn_XSb_Y]$, $Ni_Z[Nb_XPd_Y]$, $Ni_Z[Nb_XPt_Y]$, $Ni_Z[Nb_XZn_Y]$, $Ni_Z[Pd_XTa_Y]$, $Ni_Z[Pt_XSi_Y]$, $Ni_Z[Pt_XTa_Y]$, $Ni_Z[Pt_XTi_Y]$, $Ni_Z[Sb_XSi_Y]$, $Ni_Z[Sb_XTi_Y]$, $Ni_Z[Sc_XZn_Y]$, $Ni_Z[Si_XSn_Y]$, $Ni_Z[Ta_XZn_Y]$, $Ni_Z[V_XZn_Y]$, $Ni_Z[W_XZn_Y]$, and $Ni_Z[Zn_XZr_Y]$. Z is about 2.1 to about 3.9. X and Y are a number from about 0.1 to about 1.9.

In an embodiment, a superalloy composition is disclosed. The superalloy composition includes one or more phases. At least one of the one or more phases includes at least one ternary intermetallic compound that is selected from the group consisting of $Co_3[Nb_XV_Y]$, $Co_3[Re_XTi_Y]$, $Co_3[Ta_XV_Y]$, $Fe_3[Ga_XSi_Y]$, $Ni_3[Al_XRh_Y]$, $Ni_3[Au_XTa_Y]$, $Ni_3[Be_XFe_Y]$, $Ni_3[Be_XGa_Y]$, $Ni_3[Be_XMn_Y]$, $Ni_3[Be_XNb_Y]$, $Ni_3[Be_XSb_Y]$, $Ni_3[Be_XSi_Y]$, $Ni_3[Be_XTa_Y]$, $Ni_3[Be_XTi_Y]$, $Ni_3[Be_XV_Y]$, $Ni_3[Be_XW_Y]$, $Ni_3[Co_XSc_Y]$, $Ni_3[Ga_XIr_Y]$, $Ni_3[Hf_XSi_Y]$, $Ni_3[Ir_XV_Y]$, $Ni_3[Ir_XSi_Y]$, $Ni_3[Mn_XSb_Y]$, $Ni_3[Nb_XPd_Y]$, $Ni_3[Nb_XPt_Y]$, $Ni_3[Nb_XZn_Y]$, $Ni_3[Pd_XTa_Y]$, $Ni_3[R_XSi_Y]$, $Ni_3[Pt_XTa_Y]$, $Ni_3[Pt_XTi_Y]$, $Ni_3[Sb_XSi_Y]$, $Ni_3[Sb_XTi_Y]$, $Ni_3[Sc_XZn_Y]$, $Ni_3[Si_XSn_Y]$, $Ni_3[Ta_XZn_Y]$, $Ni_3[V_XZn_Y]$, $Ni_3[W_XZn_Y]$, and $Ni_3[Zn_XZr_Y]$. X and Y are a number from about 0.1 to about 1.9.

Any of the superalloy compositions disclosed herein may be used to form at least part of gas turbines, disks, combustion chambers, bolts, casings, shafts, exhaust systems, cases, turbine blades, vanes, burner cans, afterburners, thrust reversers, steam turbine power plants, reciprocating engines (e.g., turbochargers, exhaust valves, etc.), metal processing dies, medical applications, rocket engine parts, aerodynamically heated skins, heat-treating equipment, nuclear power systems (e.g., control rod drive mechanisms, etc.), chemical and petrochemical industries (e.g., reaction vessels, etc.), pollution control equipment, metal processing mills (e.g., ovens, etc.), coal gasification and liquefaction systems (e.g., heat exchangers, etc.), or any other application in which a conventional superalloy is used.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

FIG. 3 is a table listing most of the 179 ternary intermetallic compounds shown in FIG. 2 that exhibit a calculated decomposition energy and a calculated formation enthalpy that is less than the $Co_3[Al,W]$ ternary intermetallic compound along with the calculated formation enthalpy, decomposition energy, density, and bulk modulus of the ternary intermetallic compounds. For ease of illustration, FIG. 3 has been split into FIGS. 3A, 3B, 3C, and 3D.

DETAILED DESCRIPTION

Figure 1:
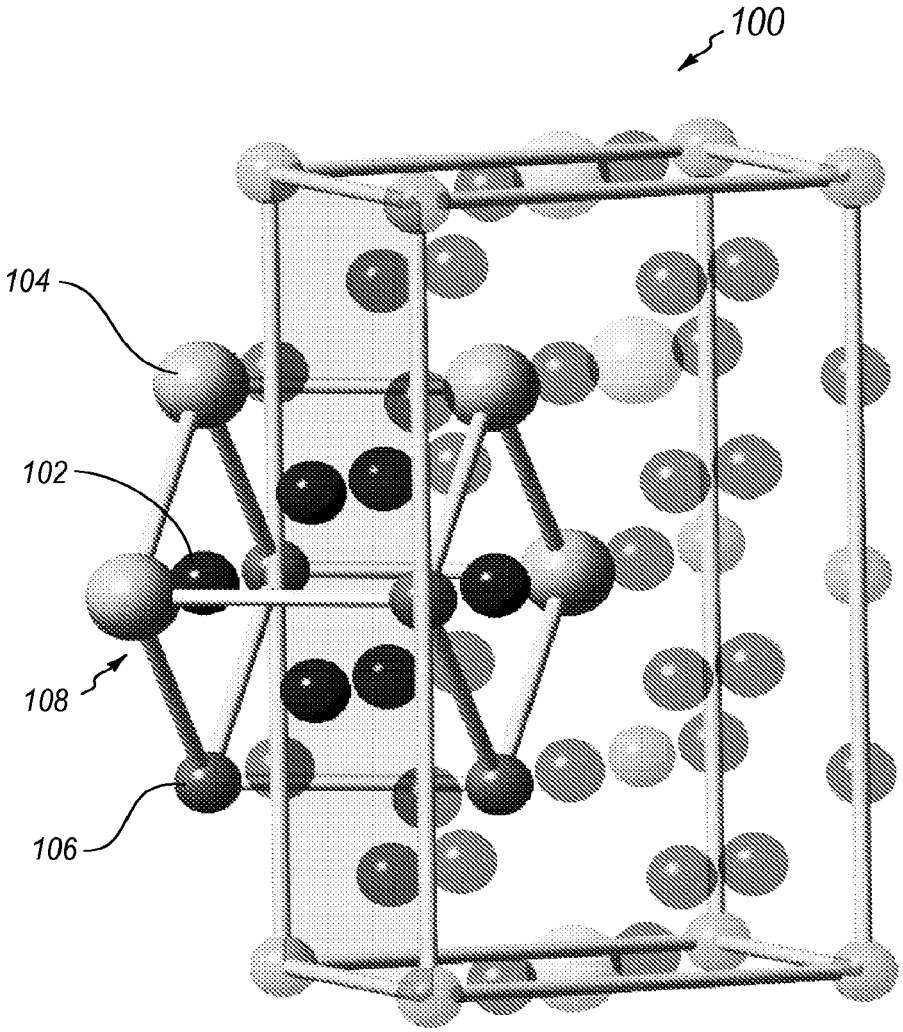
FIG. 1 is a schematic illustration of a chemical structure of a ternary intermetallic compound having a general chemical formula $A_3[B_{0.5}C_{0.5}]$ that may form at least one phase in a superalloy composition, according to an embodiment.

Embodiments disclosed herein are directed to superalloy compositions and applications using the same. The superalloy compositions disclosed herein include at least one ternary intermetallic compound having a general chemical composition of $A_Z[B_XC_Y]$. Base element A is selected from the group consisting of cobalt, iron, and nickel; and element B and element C are independently selected from different members of the group consisting of lithium, strontium, calcium, yttrium, scandium, zirconium, hafnium, titanium, niobium, tantalum, vanadium, molybdenum, tungsten, chromium, technetium, rhenium, manganese, iron, ruthenium, osmium, cobalt, iridium, rhodium, nickel, platinum, palladium, gold, silver, copper, magnesium, mercury, cadmium, zinc, beryllium, thallium, indium, aluminum, gallium, tin, silicon, and antimony. Base element A, element B, and element C are each different elements. Z is about 2.1 to about 3.9. X and Y are from about 0.1 to about 1.9. Additionally, the at least one ternary intermetallic compound of each of the superalloy compositions exhibits the face-centered cubic structure $L1_2$. The at least one ternary intermetallic compound of each of the superalloy compositions exhibits a theoretical formation enthalpy (meV) and decomposition energy (meV/atom at T=0K) less than $Co_3[Al, W]$. In particular, the at least one ternary intermetallic compound of each of the superalloy compositions exhibits a theoretical formation enthalpy less than −127 meV at T=0K and a calculated decomposition energy less than 66 meV/atom at T=0K. It is noted that it is difficult if not impossible to experimentally determine the decomposition energy at T=0K. As such, as used herein, the decomposition energy, formation enthalpy, density, and bulk modulus refer to the calculated decomposition energy, formation enthalpy, density, and bulk modulus. The calculated decomposition energy, formation enthalpy, density, and bulk modulus can be determined using the calculations disclosed herein or by using other known methods. Such known methods include experimentally measuring the decomposition energy, formation enthalpy, density, and bulk modulus at one or more temperatures greater than 0K and extrapolating the measured decomposition energy to 0K.

The fact that a metastable structure $Co_3[Al_{0.5}, W_{0.5}]$, which exhibits a decomposition energy of 66 meV/atom at T=0K and a formation enthalpy of −127 meV, has superior mechanical properties than many commercially available superalloys provided a platform to search for other ternary systems in which the SQS structure can be metastable and be a potential candidate for a good superalloy. As will be discussed in more detail hereafter, several ternary intermetallic compounds exhibit a decomposition energy and formation enthalpy that is less than $Co_3[Al_{0.5}, W_{0.5}]$. It is currently believed by the inventors that these ternary intermetallic compounds exhibit superior mechanical properties than $Co_3[Al_{0.5}, W_{0.5}]$ due to their lower decomposition energies and formation enthalpies.

The superalloy compositions disclosed herein may be used as gas turbines among many other high temperature applications. For example, the superalloy compositions including at least one of the ternary intermetallic compound disclosed herein may form at least part of at least one of disks, combustion chambers, bolts, casings, shafts, exhaust systems, cases, turbine blades, vanes, burner cans, afterburners, thrust reversers, etc. of aircraft gas turbines. The superalloy compositions including at least one of the ternary intermetallic compound disclosed herein can also form at least part of a component in steam turbine power plants, reciprocating engines (e.g., turbochargers, exhaust valves, etc.), metal processing dies, medical applications, rocket engine parts, aerodynamically heated skins, heat-treating equipment, nuclear power systems (e.g., control rod drive mechanisms, etc.), chemical and petrochemical industries (e.g., reaction vessels, etc.), pollution control equipment, metal processing mills (e.g., ovens, etc.), coal gasification and liquefaction systems (e.g., heat exchangers, etc.), or any other application in which a conventional superalloy is used.

FIG. 1 is a schematic illustration of a chemical structure of a ternary intermetallic compound having a general chemical formula $A_3[B_{0.5}C_{0.5}]$ that may form at least one phase in a superalloy composition, according to an embodiment. For example, FIG. 1 illustrates a 32-atom SQS 100 used to perform all theoretical calculations of the ternary superalloy compositions disclosed herein. The 32-atom SQS 100 includes a base element A 102, an element B 104, and an element C 106 according to the general chemical formula $A_Z[B_XC_Y]$. The 32-atom SQS 100 is formed from a plurality of face-centered cubic structures having a $L1_2$ unit cell 108 structure. The $L1_2$ unit cell 108 is shown in FIG. 1 as a smaller cube. As shown in FIG. 1, element B 104 and element C 106 are placed at the cube vertices of the $L1_2$ unit cell 108. Element A 102 is located at respective centers of the faces of the $L1_2$ unit cell 108.

As previously discussed, the ternary intermetallic compound having the general chemical formula $A_Z[B_XC_Y]$ includes the base element A 104 that is selected from the group consisting of iron, cobalt, and nickel; and an element B 106 and an element C 108 that are independently and differently selected from any of the elements disclosed herein. However, each of the base element A 104, the element B 106, and the element C 108 comprise a different element. For example, if base element A 104 comprises nickel, then element B 106 and element C 108 comprise an element that is different than nickel. Similarly, if element B 106 comprises titanium, then element C 108 comprises an element that is different than titanium.

The illustrated 32-atom SQS 100 includes a ternary intermetallic compound having the general chemical formula $A_Z[B_XC_Y]$ where Z is 3 and both X and Y are about 0.5. Similarly, in most of the calculations provided herein, the value of Z is about 3 and the values of X and Y are about 0.5. However, in any of the ternary intermetallic compounds disclosed herein, Z may exhibit any number from 2.1 to about 3.9, and X and Y may exhibit any number from about 0.1 to about 1.9. The value of Z may be different than about 3 and the values of X and/or Y may be different than about 0.5 due to at least one of vacancies (e.g., vacancies of base element A 102, element B 104, and/or element C 106), substitutions of base element A 102, element B 104, and/or element C 106 with different elements (e.g., substituting element B 104 with element C 106, substituting base element A 102 with element B 104 and/or element C 106), other elements added to the ternary intermetallic compound, heat treatment of the ternary intermetallic compound, etc. For example, In any of the ternary intermetallic compounds disclosed herein, Z may be about 2.1 to about 3, about 2.1 to about 2.5, about 2.4 to about 2.6, about 2.4 to about 3, about 2.5 to about 2.7, about 2.6 to about 2.8, about 2.7 to about 2.9, about 2.8 to about 3, about 3 to about 3.9, about 2.9 to about 3.5, about 3.3 to about 3.7, or about 3.5 to about 3.9. In another example, in any of the ternary intermetallic compounds disclosed herein, X and/or Y may be about 0.1 to about 1, about 0.1 to about 0.25, about 0.25 to about 0.5, about 0.5 to about 0.75, about 0.75 to about 1, about 0.1 to about 0.3, about 0.25 to about 0.75, about 0.4 to about 0.6, about 0.4 to about 0.5, about 1 to about 1.9, about 0.8 to about 1.2, about 1 to about 1.4, about 1.2 to about 1.6, about 1.4 to about 1.8, or about 1.5 to about 1.9. In an embodiment, X and Y may be substantially equal. In another embodiment, X and Y may be different. In an embodiment, any of the ternary intermetallic compounds disclosed herein may exhibit any combination of the foregoing ranges for X, Y, and Z.

In an embodiment, the sum of X and Y can be about 1, such as when X and Y are 0.5, element B 104 is substituted for element C 106, or element C 106 is substituted for element B 104. In an embodiment, the sum of X and Y is less than about 1, due to vacancies of element B 104, vacancies of element C 106, or substitutions of element B 104 and/or element C 106 with other elements (e.g., additives). In an embodiment, the sum of X and Y can be greater than 1, such as when element B 104 and/or element C 106 is substituted for base element A 102.

Some of the elements that can be used as element B 104 and/or element C 106 may be difficult to form into the ternary intermetallic compounds disclosed herein. For example, some of the elements that can be used as element B 104 and/or element C 106 may be relatively expensive, which may make the manufacturing process more complex due to the need to eliminate waste. In another example, some of the elements that can be used as element B 104 and/or element C 106 may be toxic. In another example, some of the elements that can be used as element B 104 and/or element C 106 may exhibit relatively low melting temperature which makes incorporating the elements into the ternary intermetallic compound more difficult than elements exhibiting a relatively high melting temperature. As such, it is currently believed by the inventors that it is easier and more efficient to form superalloy compositions that do not include gold, beryllium, cadmium, gallium, mercury, iridium, indium, lithium, osmium, palladium, platinum, rhenium, ruthenium, scandium, technetium, thallium, or other elements. However, it is understood that the superalloy compositions disclosed herein may include expensive, toxic, or low melting temperature elements based on the application of the ternary superalloy.

In an embodiment, the at least one ternary intermetallic compound may exhibit a decomposition energy that is less than Co[Al,W] (e.g., less than 66 meV/atom at T=0K). For example, the at least one ternary intermetallic compound of the ternary superalloys may exhibit a decomposition energy that is less than about 60 meV/atom at T=0K, less than about 50 meV/atom at T=0K, less than about 40 meV/atom at T=0K, less than about 30 meV/atom at T=0K, less than 20 meV/atom at T=0K, less than about 10 meV/atom at T=0K, or about 0 meV/atom at T=0K. In another example, the at least one ternary intermetallic compound may exhibit a decomposition energy that is about 0 meV/atom at T=0K to about 25 meV/atom at T=0K, about 25 meV/atom at T=0K to about 50 meV/atom at T=0K, about 10/atom at T=0K to about 30 meV/atom at T=0K, or about 40 meV/atom at T=0K to about 60 meV/atom at T=0K.

In an embodiment, the at least one ternary intermetallic compound of the ternary superalloys may exhibit a formation enthalpy that is less than the formation enthalpy of Co[Al,W] (e.g., less than −127 meV). For example, the at least one ternary intermetallic compound may exhibit a formation enthalpy that is less than about −130 meV, less than about −150 meV, less than about −170 meV, less than about −200 meV, less than about −250 meV, less than about −300 meV, or less than about −400 meV. In another example, the at least one ternary intermetallic compound of the ternary superalloys may exhibit a formation enthalpy that is about −130 meV to about −250 meV, about −200 meV to about −300 meV, about −250 meV to about −400 meV, or about −350 meV to about −500 meV. The enthalpy of formation is closely associated with the high temperature limit of an alloy. As such, ternary intermetallic compositions disclosed herein that exhibit a formation enthalpy that is less than −127 meV are likely to exhibit higher temperature limits than $Co_3$[W,Al].

A superalloy composition may include one or more phases therein. In an embodiment, the superalloy composition may include two or more phases. For example, the superalloy composition may include a first phase that forms a substantially continuous matrix (e.g., γ phase) and a second phase that is a precipitate in the first phase (e.g., γ' phase). The second phase may form about 1 volume % to about 60 volume % of the superalloy, such as about 15 volume % to about 60 volume %. Additionally, the second phase may exhibit a low crystal structure mismatch with the first phase (e.g., about 0% to about 5%, such as about 0% to about 1% or about 0.05% to about 0.6%). Similarly, the interfacial energy between the first phase and the second phase may also be low. In an embodiment, the at least one ternary intermetallic compound may form at least one of the first phase or the second phase. For example, one of the first or second phase includes the ternary intermetallic compound having the general chemical formula $A_Z[B_XC_Y]$ while the other of the first or second phase includes another ternary intermetallic compound (e.g., an face-centered cubic material) having the general chemical formula $D_G[E_HF_I]$ wherein at least one of D, E, F, G, H, or I is different than A, B, C, Z, X, or Y, respectively. In another example, the first phase may include a ternary intermetallic compound, while the second phase may include a binary intermetallic compound (e.g., having the chemical formula $J_3K$ where J is one of iron, cobalt, or nickel and K is aluminum or other element). In another example, the first phase may include a binary intermetallic compound and the second phase may include a ternary intermetallic compound. In some embodiments, the first and/or second phases may be dispersed through a solid solution phase including one or more of the elements A, B, C, D, E, or F. In an embodiment, a superalloy composition may include substantially only a single phase where the single phase is the at least one ternary intermetallic compound.

In an embodiment, the first and second phase of the superalloy may exhibit a relatively low lattice mismatch. For example, the ternary intermetallic compound is one of the first or second phase and the ternary intermetallic compound exhibits a relatively low lattice mismatch with the other of the first or second phase. Lattice mismatch is defined as the a of a difference between the lattice parameter of the first phase and the lattice parameter of the second phase ($\Delta\alpha$) to the lattice parameter of the host matrix ($\alpha_{host}$) In other words, the lattice mismatch is calculated using the equation $\Delta\alpha/\alpha_{host}$. The relatively low lattice mismatch may be less than about 5%, such as about 0% to about 1%, about 0.5% to about 1.5%, about 1% to about 2%, about 1.5% to about 2.5%, about 2% to about 3%, or about 2.5% to about 3.5%, about 3% to about 4%, about 3.5% to about 4.5%, or about 4% to about 5%. The relatively low lattice mismatch may allow the formation of coherent precipitates.

In an embodiment, the ternary intermetallic compound may exhibit a polycrystalline structure that includes a plurality of randomly oriented grains that are bonded together. For example, the ternary intermetallic compound may form a substantially continuous matrix (e.g., first phase) and/or a precipitate (e.g., second phase) that is polycrystalline. In another embodiment, the ternary intermetallic compound may form may a continuous matrix that exhibits a columnar-grain structure. The columnar-grain structure may include a plurality of oriented grains. For example, each of the oriented grains may grow along the miller index plane (100), (110), or (111) of the $L1_2$ unit cell 108 shown in FIG. 1. The columnar-grain structure may be formed by mixing additives into the ternary intermetallic compound that are selected to improve columnar-grain growth (e.g., hafnium) and/or using specific manufacturing techniques (e.g., slowly withdrawing the ternary superalloys in a mold from a furnace). In another embodiment, the ternary intermetallic compound may exhibit a single-crystal structure. The single-crystal structure may be formed by mixing additives into the ternary intermetallic compound selected to improve crystal growth and/or using specific manufacturing techniques (e.g., using a spiral channel near the bottom of a mold). The single-crystal structure may exhibit higher stress rupture capability (e.g., the temperature, load, and duration of the load at the temperature required for the superalloy composition component to fail) than a columnar-grain structure and the columnar-grain structure may exhibit a higher stress rupture capability than a polycrystalline structure. Additionally, the columnar-grain structure and especially the single-crystal structure may exhibit a relatively high resistance to creep at high temperatures and loads compared to the polycrystalline structure.

The superalloy compositions including the at least one ternary intermetallic compounds disclosed herein may be formed using any suitable technique. In an embodiment, a superalloy composition including the at least one ternary intermetallic compound may be cast into a mold. The casting process may be configured to improve the crystal structure of the ternary intermetallic compound, for example, by slowly pulling a mold including the ternary intermetallic compound therein from the furnace to encourage columnar-grain structure growth of the ternary intermetallic compound. In another embodiment, a superalloy including the at least one ternary intermetallic compound may be wrought, formed using powder metallurgy processing, or another suitable process. In another embodiment, a preformed superalloy (e.g., cast superalloy, wrought superalloy, etc.) including the at least one ternary intermetallic compound may be subjected to one or more heat treatment (e.g., a single heat treatment or a multi-stage heat treatment). For example, the preformed superalloy composition may be heated to a temperature of about 600° C. to about 1100° C. (e.g., about 700° C. to about 1000° C.) for a duration of about 1 hour to about 200 hours (e.g., 24 hours). In some embodiments, a preformed superalloy composition may be coated (e.g., with nickel aluminide, platinum aluminide, MCrAlY, cobalt-cermet, nickel-chromium, etc.) using any suitable process (e.g., pack cementation process, thermal spraying, plasma spraying, gas phase coating, bond coating, etc.).

In an embodiment, any of the ternary intermetallic compound and/or superalloy compositions disclosed herein may include one or more strengthening additives mixed therein that are configured to facilitate solid-solution strengthening of the ternary intermetallic compound and/or superalloy. The strengthening additives may include molybdenum, tungsten, aluminum, chromium, iron, titanium, vanadium, nickel, cobalt, combinations thereof, or another suitable additive. The strengthening additives may exhibit slow diffusion through the ternary intermetallic compound thereby improving creep resistance at high temperatures. In another embodiment, any of the ternary intermetallic compounds and/or superalloy compositions disclosed herein may include one or more oxidation and/or corrosion resistive additives mixed therein to improve the oxidation and/or corrosion resistance of the ternary intermetallic compound and/or superalloy. For example, the oxidation and/or corrosion resistive additives may include chromium and/or another suitable additive. In an embodiment, a nickel-based ternary intermetallic compound (e.g., element A 102 is nickel) may include iron added thereto to improve the formability and machinability of the nickel-based ternary intermetallic compound. In another embodiment, any of the ternary intermetallic compound and/or superalloy disclosed herein may include one or more precipitation forming additives mixed therein that are configured to increase volume fraction of the second phase of the superalloy. The precipitation forming additives include at least one of aluminum, titanium, tantalum, niobium, chromium, cobalt, molybdenum, tungsten, a combination thereof, or another suitable additive. In another embodiment, any of the ternary intermetallic compounds and/or superalloy compositions disclosed herein may include one or more grain boundary improving additives mixed therewith configured to reduce grain boundary sliding at high temperatures when the ternary intermetallic compound exhibits a columnar-grain structure or a polycrystalline grain structure. The grain boundary improving additives include carbon, boron, zirconium, hafnium, combinations thereof, or any other suitable additive. For example, adding carbon to the ternary intermetallic compound may result in precipitations of $M_{23}C_6$ where M is a metallic element (e.g., chromium).

Any of the additives disclosed herein may be mixed with the ternary intermetallic compound such that the additives form about 0.01 atomic % to about 25 atomic % of the ternary intermetallic compound (e.g., about 0.01 atomic % to about 0.1 atomic %, about 0.1 atomic % to about 1 atomic %, about 0.5 atomic % to about 2 atomic %, about 1 atomic % to about 5 atomic %, or about 2 atomic % to about 10 atomic %). The amount of the additives mixed with the ternary intermetallic compound depends on the purpose of the additive (e.g., additives that improve grain boundaries may form a smaller atomic % of the ternary intermetallic compound than additives that encourage precipitation), the mismatch between the additive and the elements of the ternary intermetallic compound, the composition of the ternary intermetallic compound, the structure of the ternary intermetallic compound (e.g., a polycrystalline structure may include more additives that improve grain boundaries than a columnar-grain structure), whether the additive is being substituted, etc.

Methodology of Calculating the Ternary Intermetallic Compounds

The ternary intermetallic compounds were calculated using the software package, AFLOW. AFLOW is discussed in more detail in Curtarolo et al, "AFLOW: an automatic framework for high-throughput materials discovery", Comp. Mat. Sci. 58, 218 (2012) and in Curtarolo et al. "AFLOW-LIB. ORG: A distributed materials properties repository from high-throughput ab initio calculations." Computational Materials Science 58 (2012): 227-235, the disclosures of which are incorporated herein, in their entireties, by this reference.

A 32-atom cell special quasi-random structure ("SQS-32") of the form $A_3[B_{0.5}C_{0.5}]$ is considered to mimic the properties of the alloy at high temperatures wherein 'A' is any one of cobalt, nickel or iron, and 'B' and 'C' are any of 40 different elements disclosed herein. It is noted that 'A', 'B', and 'C' are all different atoms.

The calculations were performed using the all-electron Blöchl's prohector augmented wave method within the generalized gradient approximation of Perdew, Burke, and Ernzerhof, as implemented in VASP. The k-point meshes for sampling the Brillouin zone are constructed using the Monkhorst-Pack scheme. A total number of at least 10000 k-points per reciprocal atom were used. All calculations are spin polarized. The cutoff energy was chosen to be 1.4 times the default maximum value of the three elements in the ternary system. The 0 K formation enthalpy ($\Delta H$) is calculated for the ternary superalloys $A_3[B_{0.5}C_{0.5}]$ as:

$$\Delta H = E(A_3[B_{0.5}C_{0.5}]) - \sum_m E_m, \quad (1)$$

where, $E(A_3[B_{0.5}C_{0.5}])$ is the total energy per atom of the SQS-32 $A_3[B_{0.5}C_{0.5}]$ structure and $\Sigma_m E_m$, are the sum of formation energies of potential unary or binary stable structures at the compositions. The potential unary or binary stable structures at this composition are limited to the existing database in AFLOWLIB. More information about the all-electron Blochl's prohector augmented wave method, the approximation of Perdew, Burke and Ernzerhof, VASP, and the Brillouin zone are disclosed in Kresse, Georg, and D. Joubert. "From ultrasoft pseudopotentials to the projector augmented-wave method." Physical Review B 59.3 (1999): 1758; Perdew, John P., Kieron Burke, and Matthias Ernzerhof. "Generalized gradient approximation made simple." Physical review letters 77.18 (1996): 3865; Kresse, Georg, and Jrgen Furthmller "Efficient iterative schemes for ab initio total-energy calculations using a plane-wave basis set." Physical Review B 54.16 (1996): 11169; and Monkhorst, Hendrik J., and James D. Pack. "Special points for Brillouin-zone integrations." Physical Review B 13.12 (1976): 5188; respectively, the disclosures of which are incorporated herein, in their entireties, by this reference.

The special quasi-random structure (SQS) approach has been proposed by Zunger et al., to adequately mimic the statistics of a random alloy in a relatively small supercell. FIG. 1 depicts the 32-SQS 100 that is used to perform all calculations. The 32-SQS 100 is an $L1_2$ based structure that includes base element A 102, element B 104, and element C 106, respectively. The binary and ternary alloy data in AFLOWLIB was accessed using the RESTAPI. The ternary convex-hulls are plotted using qhull code. The approach proposed by Zunger et al., RESTAPI, and the qhull code are discussed in more detail in Zunger, Alex, et al. "Special quasirandom structures." Physical Review Letters 65.3 (1990): 353; Taylor, Richard H., et al. "A RESTful API for exchanging Materials Data in the AFLOWLIB. org consortium." Computational Materials Science 93 (2014): 178-192; and Barber, C. B., et al., "The Quickhull Algorithm for Convex Hulls," ACM Transactions on Mathematical Software, 22(4):469-483, December 1996, www.qhull.org; respectively, the disclosures of which are incorporated herein, in their entireties, by this reference.

The property that identifies a material as a "good" superalloy is that it demonstrates a combination of stability and good mechanical strength at high temperatures. Such properties include, for example, the distance of the structure to convex hull (e.g., decomposition energy) that quantifies the stability of a structure and the bulk modulus. The bulk modulus is linked to the curvature of energy-volume relation. It is numerically sensitive quantity and a small deviation of few data points changes its value noticeably. The bulk modulus is calculated from energy-volume data calculated for strains of −0.02 to +0.02 in orders of 0.01 applied to unit cell, with at least four calculations for each system. The energy-volume data is fitted using murnaghan fit. The murnaghan fit is disclosed in F. D., Murnaghan (1944), "The Compressibility of Media under Extreme Pressures", Proceedings of the National Academy of Sciences of the United States of America 30: 244247, the disclosure of which is incorporated herein, in its entirety, by this reference.

The normals to the facets of the convex hulls are obtained from the qhull code[26]. Let the equation of normal for a n-nary system be:

$$a_0 + \sum_{m=1}^{n} a_m x_m = 0. \quad (2)$$

where $a_0, a_1, \ldots, a_n$, are the coefficients in the normal equation. Let the structure for which we need to find the distance has the coordinates denoted in n-dimensional space as $c_1, c_2, \ldots, c_n$, where $c_1, \ldots, c_{n-1}$, are the concentrations of n−1 elements in an n-nary system and $c_n$ is the formation enthalpy of any structure. The distance of any structure to the convex hull is computed as follows:

$$\text{distance}(d) = c_n - \frac{1}{a_n}\left(-a_0 + \sum_{m=1}^{n-1} a_m c_m\right) \quad (3)$$

The distance of the structure to convex hull is the minimum of Eqn. (3), computed for all facets of the convex hull for any structure in the system

Results of the Methodology of Calculating the Ternary Intermetallic Compounds All the calculations were performed for SQS-32 crystal structures having the chemical formula $A_Z[B_XC_Y]$, where Z is 3, X is 0.5, and Y is 0.5. Here, the base element A 102 is one of iron, cobalt, or nickel. For each base element A 102, there are 40 options for element B 104 and element C 106 which includes 38 elements chosen from the periodic table and the remaining two of three base elements. The 38 elements chosen from the periodic table are Ag, Al, Au, Be, Ca, Cd, Cr, Cu, Ga, Hf, Hg, In, Ir, Li, Mg, Mn, Mo, Nb, Os, Pd, Pt, Re, Rh, Ru, Sb, Sc, Si, Sn, Sr, Ta, Tc, Tl, Ti, W, V, Y, Zn, and Zr. The combinations lead to 780 different structures for each base element A 102, totaling 2340 structures which included 2224 different ternary intermetallic compounds. It is noted that the values discussed herein and illustrated in FIGS. 2-7 (e.g., formation enthalpy, decomposition energy, density, bulk modulus, etc.) may change if at least one of Z is not equal to 3, X is not equal to 0.5, or Y is not equal to 0.5

Figure 2:
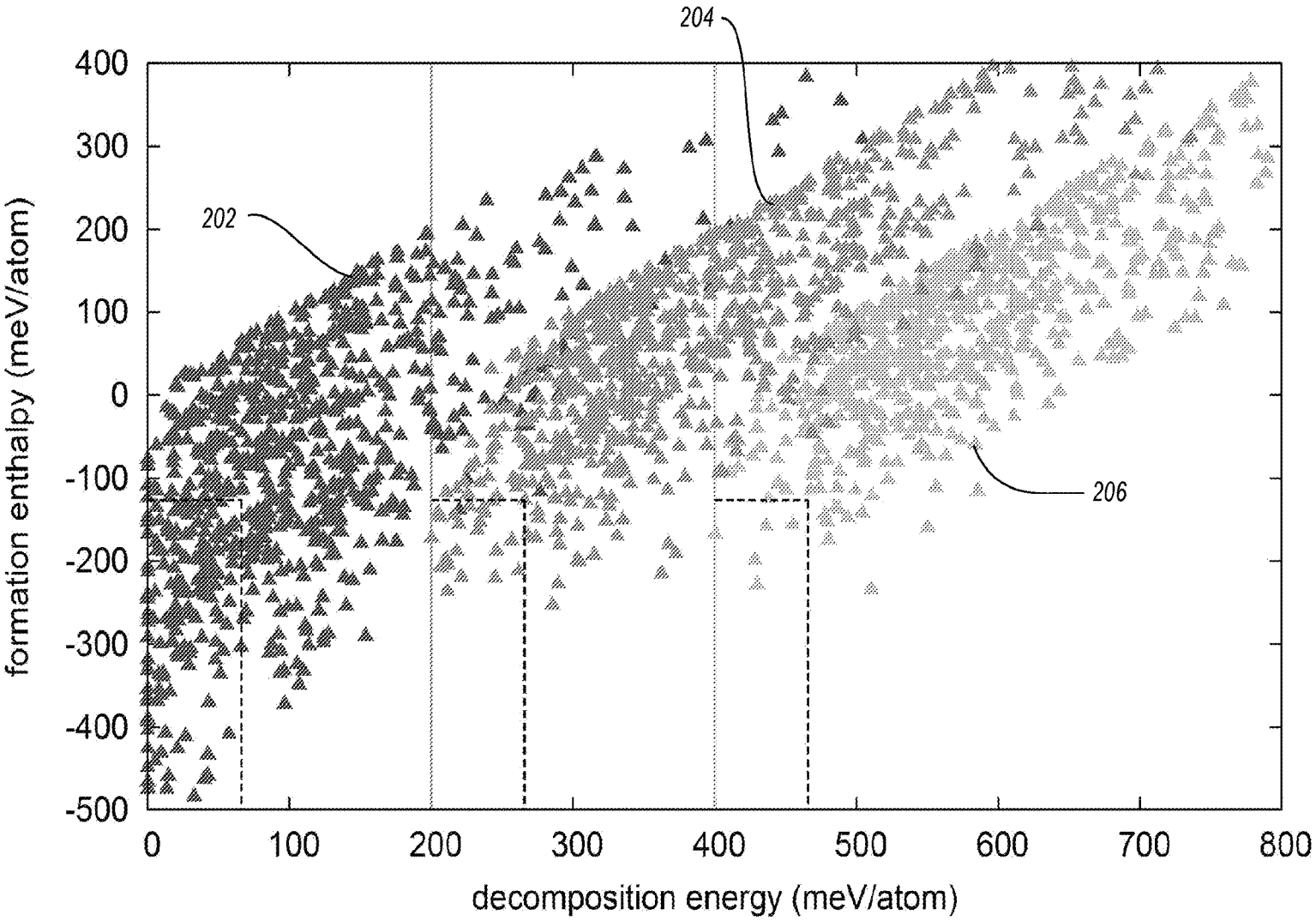
FIG. 2 is a plot of formation enthalpy of each ternary intermetallic compound relative to decomposition energy of the SQS-32 crystal structure of the respective ternary intermetallic compound, according to an embodiment.

From the results of the calculations, it was found that 2093 of the ternary intermetallic compounds are found to be compound forming. The fact that the metastable structure $Co_3[Al_{0.5}, W_{0.5}]$, which exhibits a decomposition energy of 66 meV/atom, is better than many commercially available superalloys provided a platform to search for similar ternary intermetallic compounds wherein the SQS structure may be metastable and be a potential candidate as a good superalloy compound. FIG. 2 is a plot of formation enthalpy of each ternary intermetallic compound relative to decomposition energy of the SQS-32 crystal structure of the respective ternary intermetallic compound, according to an embodiment.

Referring to FIG. 2, each triangle represents one of the ternary intermetallic compounds where the relatively dark triangles on the far left represent nickel-based ternary intermetallic compounds 202, the relatively light triangles in the middle represent cobalt-based ternary intermetallic compounds 204, and the relatively dark triangles on the far right represent iron-based ternary intermetallic compounds 206. The cobalt-based ternary superalloys 204 and the iron-based ternary superalloys 206 are displaced on the x-axis by 200 meV and 400 meV, respectively, for clarity. FIG. 2 illustrates that, on average, the nickel-based ternary superalloys 202 are more stable than the cobalt-based ternary superalloys 204 and the iron-based ternary superalloys 206. For example, the nickel-based ternary superalloys 202 generally have lower formation enthalpy than the cobalt-based ternary superalloys 204 or the iron-based ternary superalloys 206.

FIG. 2 illustrates that the formation enthalpy for many of the nickel-based superalloys 202 is as low as −400 meV. For example, at least some of the nickel-based superalloys 202 that exhibit a formation enthalpy less than −400 meV includes $Ni_ZHf_XTi_Y$, $Ni_ZHf_XSc_Y$, $Ni_ZAl_XHf_Y$, $Ni_ZAl_XTi_Y$, $Ni_ZHf_XZr_Y$, $Ni_ZSi_XTi_Y$, $Ni_ZHf_XSi_Y$, $Ni_ZSc_XTi_Y$, $Ni_ZAl_XSi_Y$, $Ni_ZTi_XZr_Y$, $Ni_ZSc_XZr_Y$, $Ni_ZAl_XTa_Y$, $Ni_ZAl_XZr_Y$, $Ni_ZSc_XSi_Y$, $Ni_ZSi_XZr_Y$, $Ni_ZAl_XSc_Y$, and $Ni_ZSc_XTa_Y$. The magnitude of formation enthalpy roughly provides an estimate for high temperature limit of any of the ternary superalloys. If a ternary superalloy composition has high negative formation enthalpy, it has high probability of withstanding higher temperatures and is hard to destabilize. Even considering the point defects and high temperature effects such as electronic, magnetic and phononic excitations, FIG. 2 illustrates that many of the ternary intermetallic compounds illustrated therein are good candidates for use in high-temperature superalloys.

The SQS-32 structure in 179 of the 2205 ternary superalloys compositions ("the 179 ternary intermetallic compounds") shown in FIG. 2 were found to exhibit better characteristics than the $Co_3[Al,W]$ superalloy in terms of decomposition energy and formation enthalpy. For example, the 179 ternary superalloys exhibit a decomposition energy that is less than 66 meV/atom at T=0K and a formation enthalpy that is less than −127 meV. The 179 superalloys are enclosed within dotted lines in FIG. 2. Out of 179 ternary superalloy compositions, 152 are nickel-based ternary superalloys 202, 22 are cobalt-based superalloys 204, and 5 are iron-based superalloys 206. FIG. 3 is a table listing most of the 179 ternary intermetallic compounds shown in FIG. 2 that exhibit a calculated decomposition energy and calculated formation enthalpy at T=0K that is less than the $Co_3[Al,W]$ ternary intermetallic compound along with the formation enthalpy, decomposition energy, density, and bulk modulus of the ternary intermetallic compounds. While FIG. 3 provides that the ternary intermetallic compounds exhibit a Z of 3, an X of 0.5, and a Y of 0.5, it is understood that the ternary intermetallic compounds listed in FIG. 3 may exhibit any suitable Z value (e.g., any number from 2.1 to 3.9), any suitable X value (e.g., any number from 0.1 to 1.9), and any suitable Y value (e.g., any number from 0.1 to 1.9). For example, the ternary intermetallic compounds listed in FIG. 3 may exhibit values and/or ranges for X, Y, and Z according to any of the embodiments disclosed herein.

It is currently believed by the inventors that at least 37 of the 179 ternary intermetallic compounds are predicted to have stable precipitate-forming $L1_2$ phases and are novel materials. These 37 ternary intermetallic compounds includes $Co_Z[Nb_XV_Y]$, $Co_Z[Re_XTi_Y]$, $Co_Z[Ta_XV_Y]$, $Fe_Z[Ga_XSi_Y]$, $Ni_Z[Al_XRh_Y]$, $Ni_Z[Au_XTa_Y]$, $Ni_Z[Be_XFe_Y]$, $Ni_Z[Be_XGa_Y]$, $Ni_Z[Be_XMn_Y]$, $Ni_Z[Be_XNb_Y]$, $Ni_Z[Be_XSb_Y]$, $Ni_Z[Be_XSi_Y]$, $Ni_Z[Be_XTa_Y]$, $Ni_Z[Be_XTi_Y]$, $Ni_Z[Be_XV_Y]$, $Ni_Z[Be_XW_Y]$, $Ni_Z[Co_XSc_Y]$, $Ni_Z[Ga_XIr_Y]$, $Ni_Z[Hf_XSi_Y]$, $Ni_Z[In_XV_Y]$, $Ni_Z[Ir_XSi_Y]$, $Ni_Z[Mn_XSb_Y]$, $Ni_Z[Nb_XPd_Y]$, $Ni_Z[Nb_XPt_Y]$, $Ni_Z[Nb_XZn_Y]$, $Ni_Z[Pd_XTa_Y]$, $Ni_Z[Pt_XSi_Y]$, $Ni_Z[Pt_XTa_Y]$, $Ni_Z[Sb_XSi_Y]$, $Ni_Z[Sb_XTi_Y]$, $Ni_Z[Sc_XZn_Y]$, $Ni_Z[Si_XSn_Y]$, $Ni_Z[Ta_XZn_Y]$, $Ni_Z[V_XZn_Y]$, $Ni_Z[W_XZn_Y]$, and $Ni_Z[Zn_XZr_Y]$. It is noted that at least some of the remaining 179 ternary intermetallic compounds may also form stable precipitate-forming $L1_2$ phases that are novel materials, have not been identified as superalloy compositions, or have not been used in certain superalloy applications. As discussed above, values and/or ranges for X, Y, and Z may be chosen according to any of the embodiments disclosed herein.

As previously discussed, some of the elements in the 37 ternary compositions discussed above make the manufacturing of the ternary intermetallic compounds difficult. For example, some of the 37 ternary intermetallic compounds discussed above include toxic or low melting temperature elements. As such, it is currently believed by the inventors that $Co_Z[Nb_XV_Y]$, $Co_Z[Ta_XV_Y]$, $Ni_Z[Hf_XSi_Y]$, $Ni_Z[Mn_XSb_Y]$, $Ni_Z[Sb_XSi_Y]$, and $Ni_Z[Sb_XTi_Y]$ are ternary superalloy compositions that may exhibit improved manufacturing efficiencies compared to the remaining 179 ternary intermetallic compounds.

Twenty-seven of the ternary intermetallic compounds calculated exhibit a decomposition energy of 0 meV/atom at T=0K. These elements are expected to have high-temperature stability. It is a general notion that ordered structures will be more stable at 0 K than the corresponding random solution at the same composition. The results showing these structures exhibit a decomposition energy of 0 meV/atom at T=0K is an indication that there might be an ordered stable compound at this composition which is yet to be found. The twenty-seven ternary intermetallic compounds includes $Ni_3[Cr_{0.5}Zn_{0.5}]$, $Ni_3[In_{0.5}Ta_{0.5}]$, $Ni_3[Li_{0.5}W_{0.5}]$, $Ni_3[Mo_{0.5}Zn_{0.5}]$, $Ni_3[Nb_{0.5}Sc_{0.5}]$, $Ni_3[Nb_{0.5}Zn_{0.5}]$, $Ni_3[Sc_{0.5}Ta_{0.5}]$, $Ni_3[Sc_{0.5}Ti_{0.5}]$, $Ni[Sc_{0.5}V_{0.5}]$, $Ni_3[Ta_{0.5}Zn_{0.5}]$, $Ni_3[V_{0.5}Zn_{0.5}]$, $Ni_3[W_{0.5}Zn_{0.5}]$, $Ni_3[Al_{0.5}Nb_{0.5}]$, $Ni_3[Al_{0.5}Sb_{0.5}]$, $Ni_3[Al_{0.5}Ta_{0.5}]$, $Ni_3[Al_{0.5}Ti_{0.5}]$, $Ni_3[Al_{0.5}W_{0.5}]$, $Co_3[Ti_{0.5}W_{0.5}]$, $Ni_3[Fe_{0.5}Mn_{0.5}]$, $Ni_3[Ga_{0.5}Nb_{0.5}]$, $Ni_3[Ga_{0.5}Sb_{0.5}]$, $Ni_3[Ga_{0.5}Ta_{0.5}]$, $Ni_3[Ga_{0.5}Ta_{0.5}]$, $Ni_3[Gab_{0.5}V_{0.5}]$, $Ni_3[In_{0.5}Sb_{0.5}]$, $Ni_3[Sn_{0.5}Sb_{0.5}]$, and $Ni_3[Sb_{0.5}Zn_{0.5}]$. Some of these twenty-seven ternary intermetallic compounds are listed in FIG. 3.

Figure 4A:
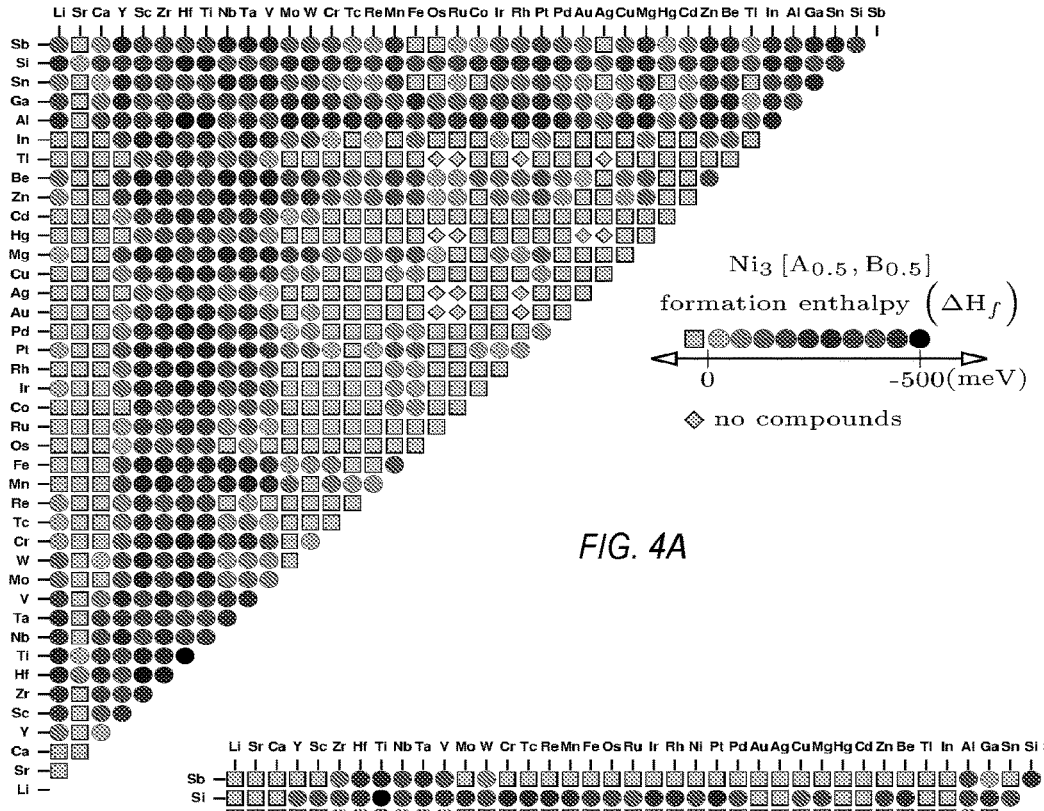
FIGS. 4A-4C are Pettifor maps illustrating the formation enthalpy (meV) for the nickel-based ternary intermetallic compounds, the cobalt-based ternary intermetallic compounds, and the iron-based ternary intermetallic compounds illustrated in FIG. 2, respectively.
Figure 4B:
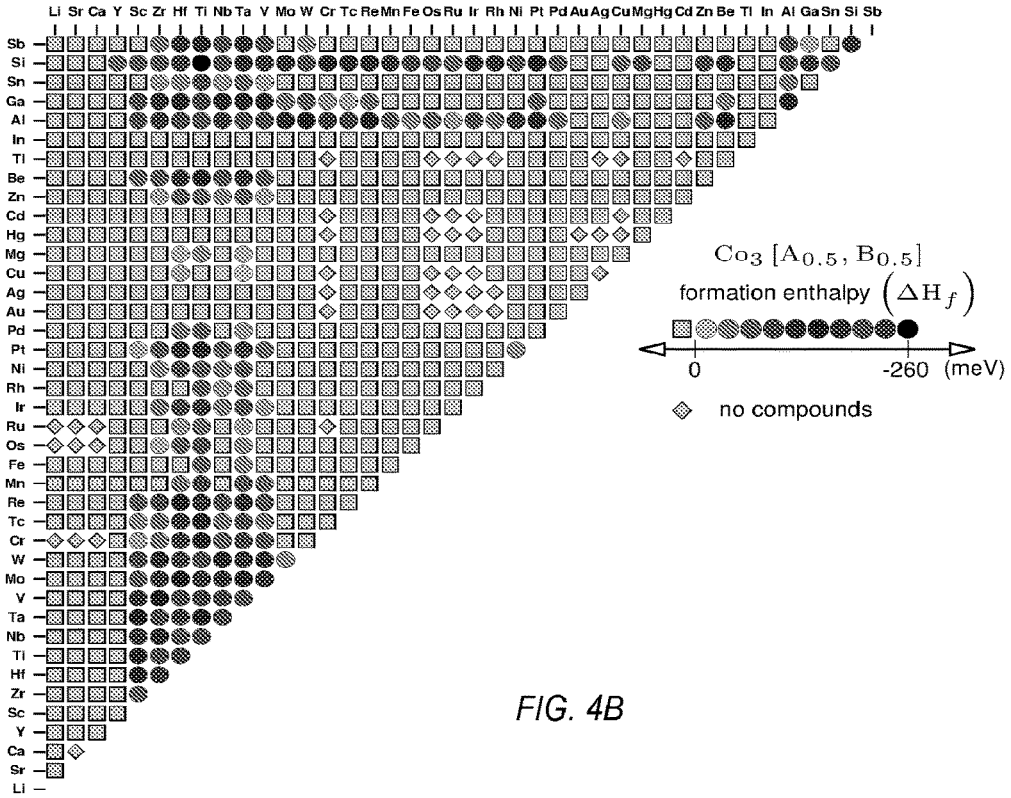
Figure 4C:
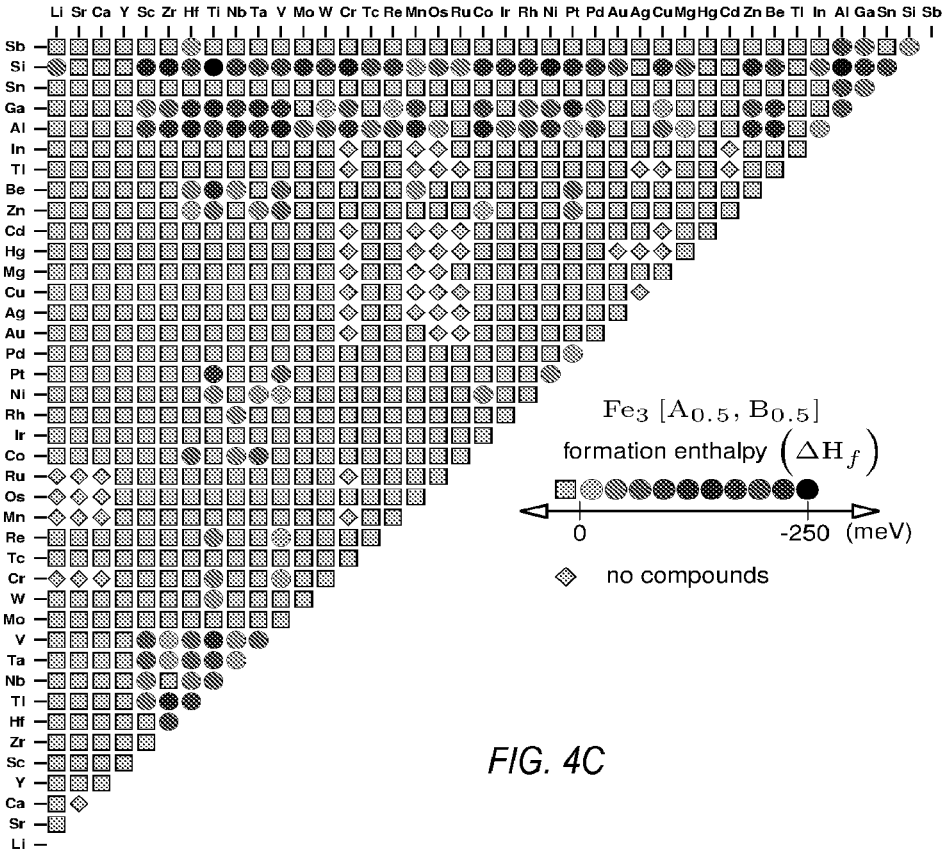
Figure 5A:
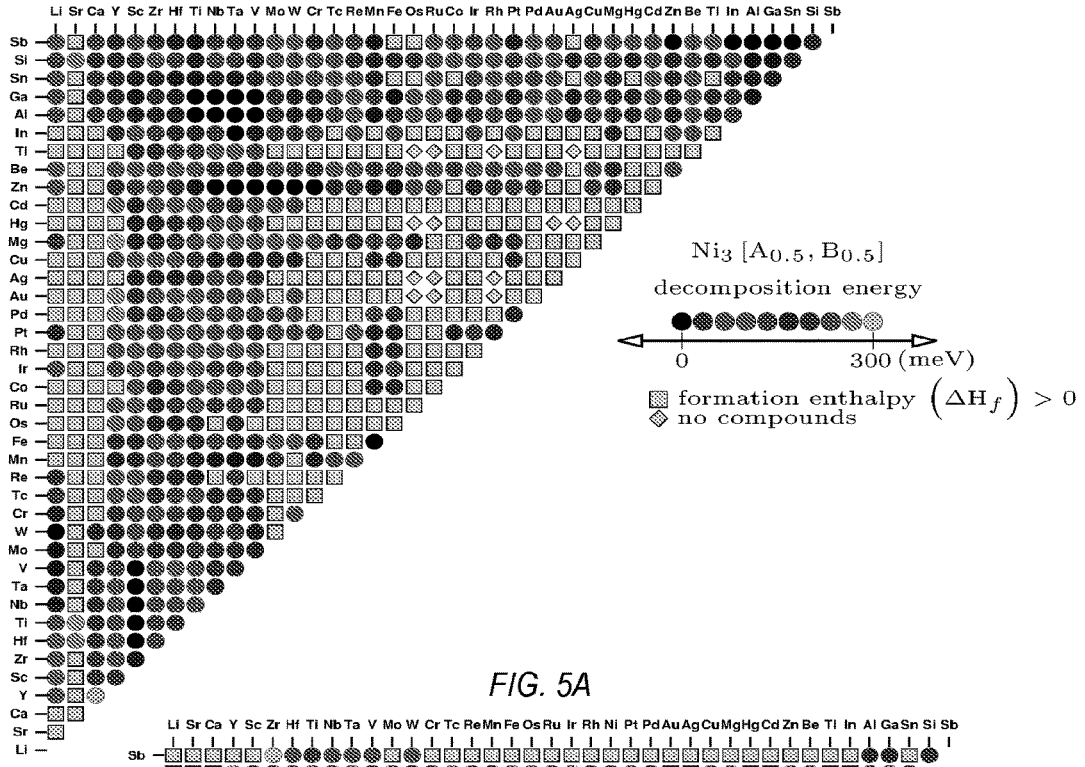
FIGS. 5A-5C are Pettifor maps illustrating the decomposition energy (meV/atom at T=0K) for the nickel-based ternary intermetallic compounds, the cobalt based ternary intermetallic compounds, and the iron-based ternary intermetallic compounds illustrated in FIG. 2, respectively.
Figure 5B:
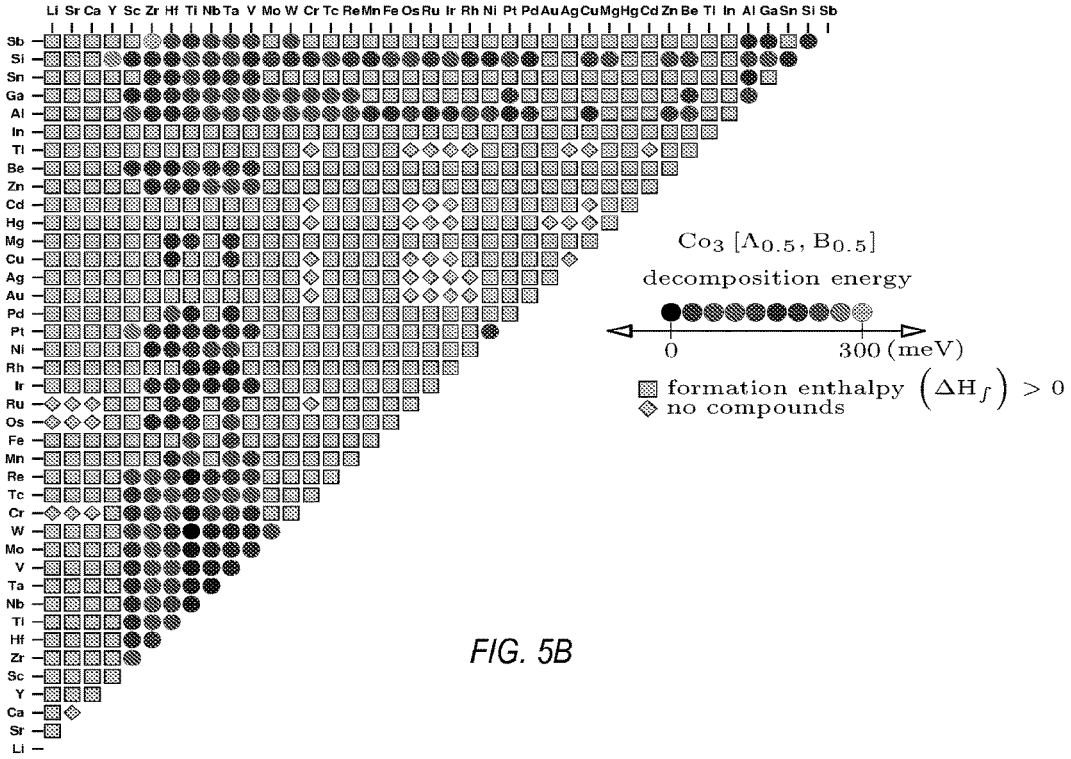
Figure 5C:
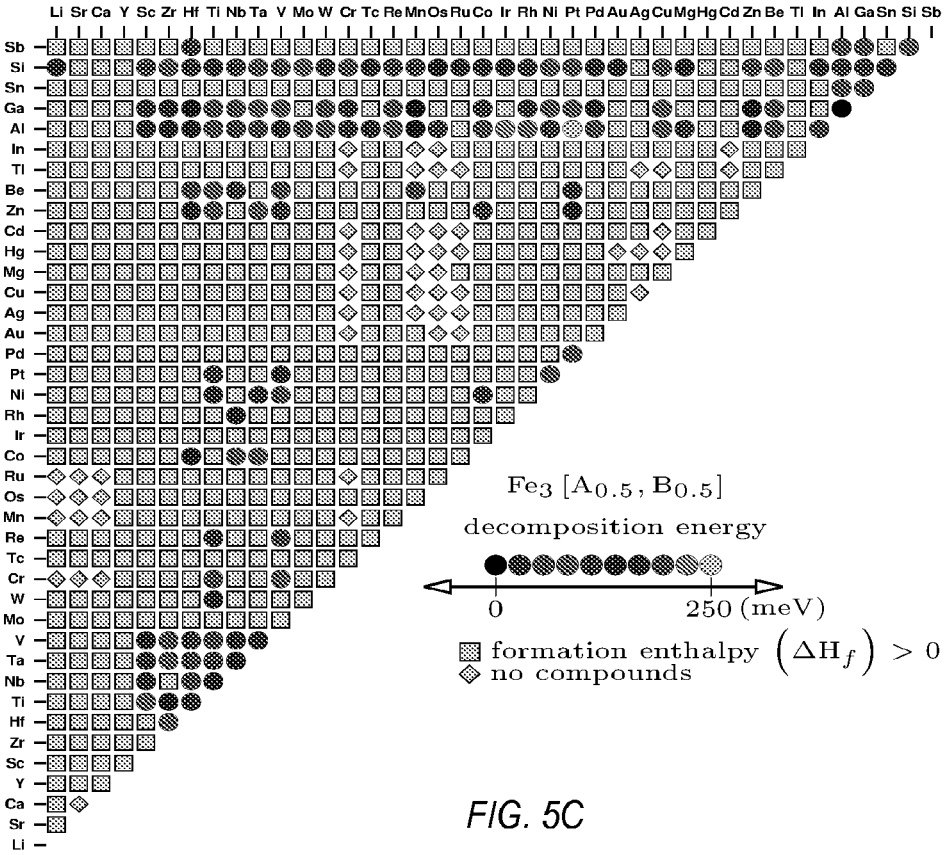

FIGS. 4A-4C are Pettifor maps illustrating the formation enthalpy (meV) for the nickel-based ternary intermetallic compounds 202, the cobalt-based ternary intermetallic compounds 204, and the iron-based ternary intermetallic compounds 206 illustrated in FIG. 2, respectively. FIGS. 5A-5C are Pettifor maps illustrating the decomposition energy (meV/atom at T=0K) for the nickel-based ternary intermetallic compounds 202, the cobalt-based ternary intermetallic compounds 204, and the iron-based ternary intermetallic compounds 206 illustrated in FIG. 2, respectively. According to the chemical formula $A_3[B_{0.5}C_{0.5}]$, the elements shown in along the x-axis and the y-axis of FIGS. 4A-5C represent element B and C, respectively. All the elements are arranged along the axes as per increasing chemical scale introduced by Pettifor. In FIGS. 4A-5C, squares indicate that the SQS-32 crystal structure has positive formation enthalpy, diamonds indicates that there exists no stable binary or ternary compounds in the respective ternary intermetallic compounds, and circles indicate that the SQS-32 structure has negative formation enthalpy. Each circle, square or diamond represents the combination for 'B' and 'C' elements in $Ni_3/Co_3/Fe_3[B,C]$ system mentioned along the x and y axis respectively. The results of 2340 calculations (780 calculations for each base element) can be seen in these three figures. While FIGS. 4A-5C provides that the ternary intermetallic compounds exhibit a Z of 3, an X of 0.5, and a Y of 0.5, it is understood that the ternary intermetallic compounds shown in FIGS. 4A-5C may exhibit any suitable Z value (e.g., any number from 2.1 to 3.9), any suitable X value (e.g., any number from 0.1 to 1.9), and any suitable Y value (e.g., any number from 0.1 to 1.9).

FIGS. 4A and 5A illustrates that, for nickel-based ternary intermetallic compounds 202, ternary intermetallic elements (e.g., element B and/or element C) that include the transition metals and metalloids including Y, Sc, Zr, Hf, Ti, Nb, Ta, Al, Ga, Si and Sb are better at forming stable ternary intermetallic compounds that are expected to exhibit better mechanical properties than $Co_3$[Al,W]. FIGS. 4B and 5B illustrates that, for cobalt-based ternary intermetallic compounds 204 that include Zr, Hf, Ti, Nb, Ta, and Al are better at forming stable ternary intermetallic compounds that are expected to exhibit better mechanical properties than $Co_3$[Al,W]. FIGS. 4C and 5C illustrates that, for iron-based ternary intermetallic compounds 206, the transition metals are not really contributing much to the stability of ternary intermetallic compounds and that combinations of Al, Si, Hf and Ti with iron tend to produce some stable ternary intermetallic compounds that are expected to exhibit better mechanical properties than $Co_3$[Al,W]. As such, at least one of element B (e.g., element B of FIG. 1) or element C (e.g., element C of FIG. 1) may be selected from yttrium, scandium, zirconium, hafnium, titanium, niobium, tantalum, vanadium, silicon, tin, gallium, aluminum, or indium.

FIGS. 4A-5C illustrate that chromium, osmium, ruthenium, strontium, silver, thallium, and mercury are less likely to form ternary intermetallic compounds exhibiting a formation enthalpy less than −130 meV. As such, in an embodiment, at least one of element B (e.g., element B of FIG. 1) or element C (e.g., element C of FIG. 1) may be selected from lithium, calcium, yttrium, scandium, zirconium, hafnium, titanium, niobium, tantalum, vanadium, molybdenum, tungsten, technetium, rhenium, manganese, iron, cobalt, iridium, rhodium, nickel, platinum, palladium, gold, copper, magnesium, cadmium, zinc, beryllium, indium, aluminum, gallium, tin, silicon, and antimony.

FIGS. 4A-5C illustrate that the formation enthalpy for nickel-based ternary intermetallic compounds 202, on average, is almost double the average formation enthalpy for the cobalt-based ternary intermetallic compounds 204 and/or the iron-base ternary intermetallic compounds 206. The results indicate that many nickel-based ternary intermetallic compounds 202 are thermodynamically more stable than cobalt-based ternary intermetallic compounds 204 or iron-based ternary intermetallic compounds 206.

Low density and high-temperature strength are the two main properties to compare any two superalloy compositions (e.g., superalloy compositions that include at least one ternary intermetallic compound therein). For example, increased density can result in increased stress on mating components in aircraft gas turbines. FIG. 3 provides the calculated density for some of the 179 ternary intermetallic compounds at T=0K. FIG. 3 illustrates that the ternary intermetallic compounds disclosed herein have a density (e.g., theoretical density) at T=0K of about 7.2 g/cm$^3$ to about 12.6 g/cm$^3$. For example, cobalt-based ternary intermetallic compounds (e.g., base element A 102 is cobalt) exhibit a density at T=0K of about 8.4 g/cm$^3$ to about 12.6 g/cm$^3$ (e.g., about 9.0 g/cm$^3$ to about 11 g/cm$^3$, or about 8.0 g/cm$^3$ to about 10 g/cm$^3$), nickel-based ternary intermetallic compounds exhibit a density at T=0K of about 7.2 g/cm$^3$ to about 12.3 g/cm$^3$ (e.g., about 7.2 g/cm$^3$ to about 9 g/cm$^3$, or about 8 g/cm$^3$ to about 9 g/cm$^3$), and iron-based ternary intermetallic compounds exhibit a density at T=0K of about 6.8 g/cm$^3$ to about 9.3 g/cm$^3$ (e.g., about 7.5 g/cm$^3$ to about 8.5 g/cm$^3$). In an embodiment, the density at T=0K of the ternary intermetallic compound is less than about 7.8 g/cm$^3$.

The calculated bulk modulus (e.g., theoretical bulk modulus) at T=0K for the 179 ternary intermetallic compounds is provided in FIG. 3. FIG. 3 shows that the cobalt-based ternary intermetallic compounds are more resistant to compression at T=0K than the nickel-based ternary intermetallic compounds. All of the cobalt-based and iron-based ternary intermetallic compounds have a bulk modulus at T=0K of at least 200 GPa. This corroborates the fact that the cobalt-based ternary intermetallic compounds and iron-based ternary intermetallic compounds have better mechanical properties than many of the nickel-based ternary intermetallic compounds. FIG. 3 also shown that about 40% of the ternary intermetallic compounds disclosed therein have a bulk modulus at T=0K greater than 200 GPa.

Figure 6:
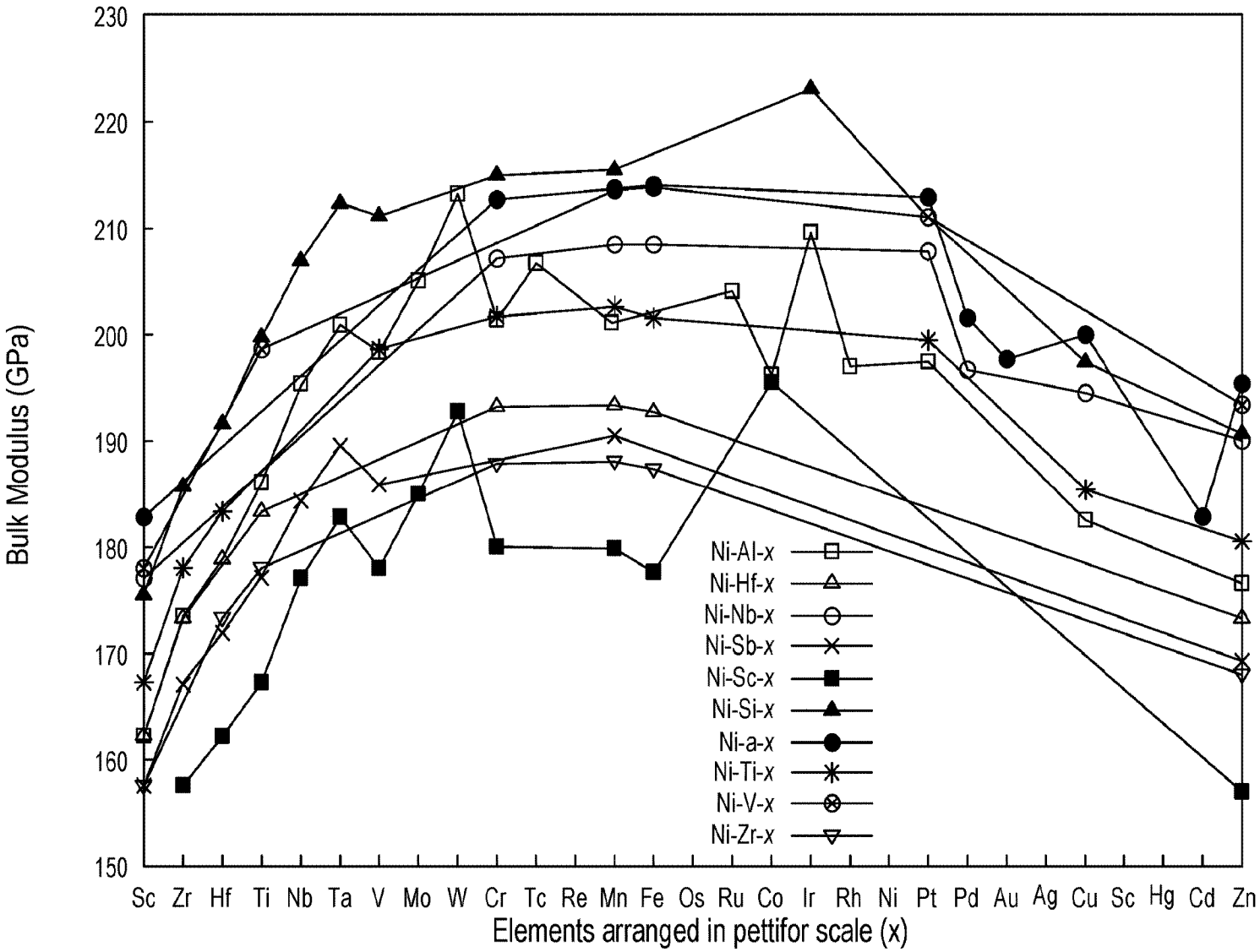
FIG. 6 is a graph of the magnitude of bulk modulus for an Ni-A-x ternary intermetallic compound where A is Al, Hf, Nb Sb, Sc, Si, Ta, Ti, V, W and Zr and 'x' is the third element in the nickel-based ternary intermetallic compound, according to various embodiments.
Figure 7:
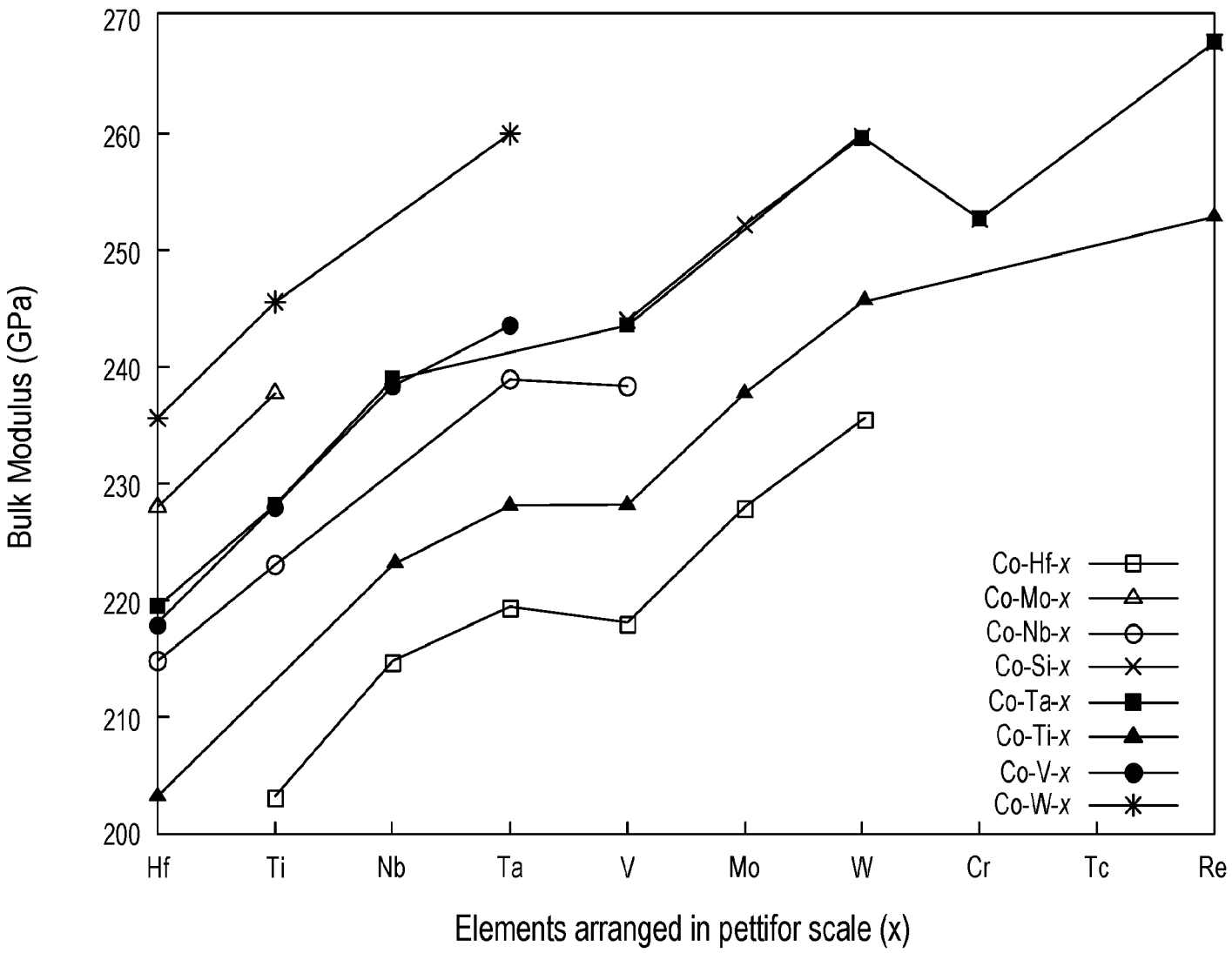
FIG. 7 is a graph of the magnitude of the bulk modulus for a Co-A-x ternary intermetallic compound where A is Al, Hf, Mo, Nb, Si, Ta, Ti, V and W and 'x' is the third element in the ternary intermetallic compound, according to various embodiments.

FIG. 6 is a graph of the magnitude of bulk modulus at T=0K for an Ni-A-x ternary intermetallic compound where A is Al, Hf, Nb Sb, Sc, Si, Ta, Ti, V, W and Zr and 'x' is the third element in the nickel-based ternary intermetallic compound, according to various embodiments. FIG. 7 is a graph of the magnitude of the bulk modulus at T=0K for a Co-A-x ternary intermetallic compound where A is Al, Hf, Mo, Nb, Si, Ta, Ti, V and W and 'x' is the third element in the ternary intermetallic compound, according to various embodiments. The composition of A is arranged along the x-axis of FIGS. 6 and 7 in increasing order of chemical scale introduced by Pettifor. The chemical scale is discussed in more detail in Pettifor, D. G. "A chemical scale for crystal-structure maps." Solid state communications 51.1 (1984): 31-34, the disclosure of which is incorporated herein, in its entirety, by this reference.

FIG. 6 illustrates that the bulk modulus at T=0K of nickel-based ternary intermetallic compounds initial exhibit a general increase in the bulk modulus thereof as the chemical scale of A increases. However, at some point, the bulk modulus at T=0K of the nickel-based ternary intermetallic compounds shown in FIG. 6 generally decrease as the chemical scale of A increases. FIG. 7 illustrates that the bulk modulus at T=0K of the cobalt-based ternary intermetallic compounds generally increase in the bulk modulus at T=0K thereof as the chemical scale of A increases.

Applications for the Disclosed Superalloy Compositions

Figure 8:
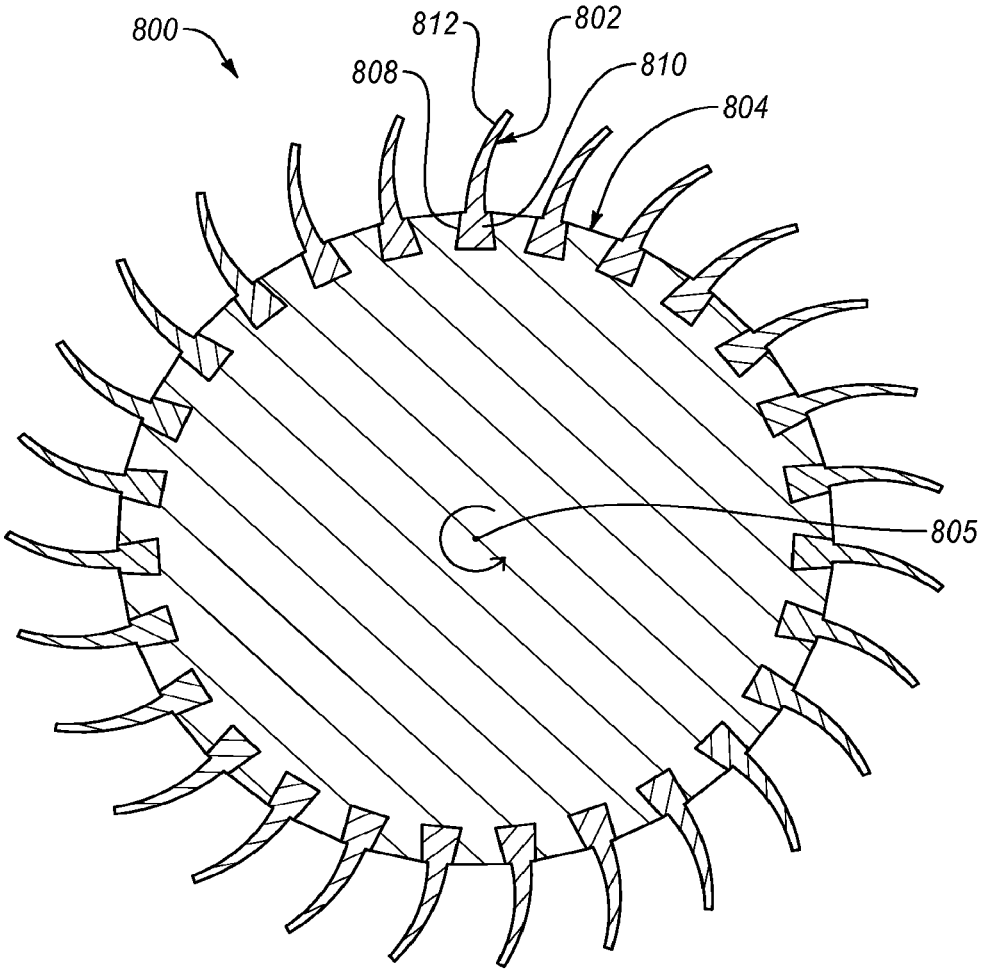
FIG. 8 is a cross-sectional view of a turbine engine including at least one turbine blade comprising a superalloy that includes at least one of the ternary intermetallic compounds disclosed herein, according to an embodiment.

The ternary intermetallic compounds disclosed herein may be used in any of the applications disclosed herein. For example, FIG. 8 is a cross-sectional view of a turbine engine 800 including at least one turbine blade 802 comprising a superalloy composition that includes at least one of the ternary intermetallic compounds disclosed herein, according to an embodiment. For example, the at least one turbine blade 802 may be formed from a superalloy composition that includes at least one of the ternary intermetallic compound disclosed in FIG. 3. The turbine engine 800 includes a base portion 804 that is configured to rotate about an axis 805 (e.g., rotation axis). The illustrated base portion 804 includes a generally cylindrical body that extends about the axis 805. The base portion 804 may be configured to have one or more turbine blades 802 attached thereto. For example, the base portion 804 may define one or more recesses 808 therein that are configured to have the at least one turbine blade 802 at least partially positioned therein. The turbine blades 802 may be attached to the recesses 808 using any suitable method, such as brazing or press fitting. In some embodiments, the recesses 808 may be omitted and the turbine blades 802 may be attached to the base portion 804 using another method. For simplicity, the base portion 804 is illustrated has only having one turbine blade 802 attached thereto. However, it is understood that the base portion 804 may include a plurality of turbine blades 802 attached thereto.

The at least one turbine blade 802 may include a bottommost region 810 at is configured to be attached to the base portion 804. For example, the bottommost region 810 of the turbine blade 802 may be configured to be positioned within the recesses 806 and attached thereto. The turbine blade 802 may also include a blade portion 812 that extends from the bottommost region 810. The blade portion 812 may exhibit a shape that is configured to cause the base portion 804 to rotate about the axis 806 as air flows past the blade portion 812 in a direction that is at least partially parallel to the axis 806. For example, the blade portion 812 may exhibit a generally tear cross-sectional shape.

At least a portion of the turbine blade 802 (e.g., the blade portion 812 and/or the bottommost portion 810) comprises a superalloy composition that includes at least one of the ternary intermetallic compounds disclosed herein. Additionally, at least one of the ternary intermetallic compound (e.g., a superalloy composition that includes at least one of the ternary intermetallic compounds) disclosed herein may at least partially form one or more additional components of the turbine engine 800, such as the base portion 804.

While various aspects and embodiments have been disclosed herein, other aspects and embodiments are contemplated. The various aspects and embodiment disclosed herein are for purposes of illustration and are not intended to be limiting.

What is claimed is:

1. A superalloy composition, comprising:

at least one ternary intermetallic compound exhibiting a calculated decomposition energy that is less than 66 meV/atom at T=0K and a calculated formation enthalpy at T=0K that is less than −127 meV, the at least one ternary intermetallic compound having chemical formula of $A_Z[B_XC_Y]$;

wherein a base element A, an element B, and an element C are chosen such that the at least one ternary intermetallic compound is selected from the group consisting of $Co_Z[Re_XTi_Y]$, $Co_Z[Ta_XV_Y]$, $Fe_Z[Ga_XSi_Y]$, $Ni_Z[Al_XRh_Y]$, $Ni_Z[Al_XSb_Y]$, $Ni_Z[Al_XSc_Y]$, $Ni_Z[Au_XTa_Y]$, $Ni_Z[Be_XFe_Y]$, $Ni_Z[Be_XGa_Y]$, $Ni_Z[Be_XMn_Y]$, $Ni_Z[Be_XNb_Y]$, $Ni_Z[Be_XSb_Y]$, $Ni_Z[Be_XSi_Y]$, $Ni_Z[Be_XTa_Y]$, $Ni_Z[Be_XTi_Y]$, $Ni_Z[Be_XV_Y]$, $Ni_Z[Be_XW_Y]$, $Ni_Z[Co_XSc_Y]$, $Ni_Z[Ga_XIr_Y]$, $Ni_Z[Ga_XNb_Y]$, $Ni_Z[Ga_XSb_Y]$, $Ni_Y[Ga_XTa_Y]$, $Ni_Z[Ga_XTi_Y]$, $Ni_Z[Ga_XV_Y]$, $Ni_Z[Hf_XSc_Y]$, $Ni_Z[Hf_XZr_Y]$, $Ni_Z[In_XSb_Y]$, $Ni_Z[In_XTa_Y]$, $Ni_Z[In_XV_Y]$, $Ni_Z[Ir_XSi_Y]$, $Ni_Z[Nb_XPd_Y]$, $Ni_Z[Nb_XPt_Y]$, $Ni_Z[Nb_XSc_Y]$, $Ni_Z[Nb_XZn_Y]$, $Ni_Z[Pd_XTa_Y]$, $Ni_Z[Pt_XSi_Y]$, $Ni_Z[Pt_XTa_Y]$, $Ni_Z[Pt_XTi_Y]$, $Ni_Z[Sb_XSi_Y]$, $Ni_Z[Sb_XTi_Y]$, $Ni_Z[Sb_XZn_Y]$, $Ni_Z[Sc_XSi_Y]$, $Ni_Z[Sc_XTa_Y]$, $Ni_Z[Sc_XTi_Y]$, $Ni_Z[Sc_XV_Y]$, $Ni_Z[Sc_XZn_Y]$, $Ni_Z[Sc_XZr_Y]$, $Ni_Z[Sn_XSb_Y]$, $Ni_Z[Ta_XZn_Y]$, $Ni_Z[V_XZn_Y]$, $Ni_Z[W_XZn_Y]$, and $Ni_Z[Zn_XZr_Y]$;

Z is about 2.1 to about 3.9; and

X and Y are each about 0.1 to about 1.9.

2. The superalloy composition of claim 1 wherein the at least one ternary intermetallic compound is selected from the group consisting of $Co_Z[Re_XTi_Y]$, $Co_Z[Ta_XV_Y]$, $Fe_Z[Ga_XSi_Y]$, $Ni_Z[Al_XRh_Y]$, $Ni_Z[Au_XTa_Y]$, $Ni_Z[Be_XFe_Y]$, $Ni_Z[Be_XGa_Y]$, $Ni_Z[Be_XMn_Y]$, $Ni_Z[Be_XNb_Y]$, $Ni_Z[Be_XSb_Y]$, $Ni_Z[Be_XSi_Y]$, $Ni_Z[Be_XTa_Y]$, $Ni_Z[Be_XTi_Y]$, $Ni_Z[Be_XV_Y]$, $Ni_Z[Be_XW_Y]$, $Ni_Z[Co_XSc_Y]$, $Ni_Z[Ga_XIr_Y]$, $Ni_Z[In_XV_Y]$, $Ni_Z[Ir_XSi_Y]$, $Ni_Z[Nb_XPd_Y]$, $Ni_Z[Nb_XPt_Y]$, $Ni_Z[Nb_XZn_Y]$, $Ni_Z[Pd_XTa_Y]$, $Ni_Z[Pt_XSi_Y]$, $Ni_Z[Pt_XTa_Y]$, $Ni_Z[Pt_XTi_Y]$, $Ni_Z[Sb_XSi_Y]$, $Ni_Z[Sb_XTi_Y]$, $Ni_Z[Sc_XZn_Y]$, $Ni_Z[Ta_XZn_Y]$, $Ni_Z[V_XZn_Y]$, $Ni_Z[W_XZn_Y]$, and $Ni_Z[Zn_XZr_Y]$.

3. The superalloy composition of claim 2 wherein the at least one ternary intermetallic compound is selected from the group consisting of $Co_Z[Ta_XV_Y]$, $Ni_Z[Sb_XSi_Y]$, and $Ni_Z[Sb_XTi_Y]$.

4. The superalloy composition of claim 2 wherein the at least one ternary intermetallic compound is selected from the group consisting of $Co_Z[Re_XTi_Y]$, $Co_Z[Ta_XV_Y]$, $Fe_Z[Ga_XSi_Y]$, $Ni_Z[Al_XRh_Y]$, $Ni_Z[Au_XTa_Y]$, $Ni_Z[Be_XFe_Y]$, $Ni_Z[Be_XGa_Y]$, and $Ni_Z[Be_XMn_Y]$.

5. The superalloy composition of claim 2 wherein the at least one ternary intermetallic compound is selected from the group consisting of $Ni_Z[Be_XNb_Y]$, $Ni_Z[Be_XSb_Y]$, $Ni_Z[Be_XSi_Y]$, $Ni_Z[Be_XTa_Y]$, $Ni_Z[Be_XTi_Y]$, $Ni_Z[Be_XV_Y]$, $Ni_Z[Be_XW_Y]$, $Ni_Z[Co_XSc_Y]$, and $Ni_Z[Ga_XIr_Y]$.

6. The superalloy composition of claim 2 wherein the at least one ternary intermetallic compound is selected from the group consisting of $Ni_Z[In_XV_Y]$, $Ni_Z[Ir_XSi_Y]$, $Ni_Z[Nb_XPd_Y]$, $Ni_Z[Nb_XPt_Y]$, $Ni_Z[Nb_XZn_Y]$, $Ni_Z[Pd_XTa_Y]$, $Ni_Z[Pt_XSi_Y]$, $Ni_Z[Pt_XTa_Y]$, and $Ni_Z[Pt_XTi_Y]$.

7. The superalloy composition of claim 2 wherein the at least one ternary intermetallic compound is selected from the group consisting of $Ni_Z[Sb_XSi_Y]$, $Ni_Z[Sb_XTi_Y]$, $Ni_Z[Sc_XZn_Y]$, $Ni_Z[Ta_XZn_Y]$, $Ni_Z[V_XZn_Y]$, $Ni_Z[W_XZn_Y]$, and $Ni_Z[Zn_XZr_Y]$.

8. The superalloy composition of claim 1 wherein the base element A, the element B, and the element C are chosen such that the at least one ternary intermetallic compound is selected from the group consisting of $Ni_3[In_{0.5}Ta_{0.5}]$, $Ni_3[Nb_{0.5}Sc_{0.5}]$, $Ni_3[Nb_{0.5}Zn_{0.5}]$, $Ni_3[Sc_{0.5}Ta_{0.5}]$, $Ni_3[Sc_{0.5}Ti_{0.5}]$, $Ni_3[Sc_{0.5}V_{0.5}]$, $Ni_3[Ta_{0.5}Zn_{0.5}]$, $Ni_3[V_{0.5}Zn_{0.5}]$, $Ni_3[W_{0.5}Zn_{0.5}]$, $Ni_3[Al_{0.5}Sb_{0.5}]$, $Ni_3[Ga_{0.5}Nb_{0.5}]$, $Ni_3[Ga_{0.5}Sb_{0.5}]$, $Ni_3[Ga_{0.5}Ta_{0.5}]$, $Ni_3[Ga_{0.5}Ti_{0.5}]$, $Ni_3[Ga_{0.5}V_{0.5}]$, $Ni_3[In_{0.5}Sb_{0.5}]$, $Ni_3[Sn_{0.5}Sb_{0.5}]$, and $Ni_3[Sb_{0.5}Zn_{0.5}]$.

9. The superalloy composition of claim 1 wherein the base element A, the element B, and the element C are chosen such that the at least one ternary intermetallic compound is selected from the group consisting of $Ni_ZHf_XSc_Y$, $Ni_ZHf_XZr_Y$, and $Ni_ZSc_XTi_Y$.

10. The superalloy composition of claim 1 wherein the base element A, the element B, and the element C are chosen such that the at least one ternary intermetallic compound is selected from the group consisting of $Ni_ZSc_XSi_Y$, $Ni_ZAl_XSc_Y$, $Ni_ZSc_XZr_Y$, and $Ni_ZSc_XTa_Y$.

11. The superalloy composition of claim 1 wherein Z is about 3.

12. The superalloy composition of claim 11 wherein each of X and Y is about 0.5.

13. The superalloy composition of claim 11 wherein a sum of X and Y is about 1.

14. The superalloy composition of claim 11 wherein a sum of X and Y is less than about 1.

15. The superalloy composition of claim 11 wherein a sum of X and Y is greater than about 1.

16. The superalloy composition of claim 1 wherein the at least one ternary intermetallic compound exhibits a calculated density at T=0K of about 9.0 g/cm$^3$ to about 11 g/cm$^3$.

17. The superalloy composition of claim 1 wherein the at least one ternary intermetallic compound exhibits a calculated density at T=0K of about 7.2 g/cm$^3$ to about 9 g/cm$^3$.

18. The superalloy composition of claim 1 wherein the calculated formation enthalpy at T=0K of the at least one ternary intermetallic compound is less than about −200 meV.

19. The superalloy composition of claim 1 wherein the calculated decomposition energy of the at least one ternary intermetallic compound is less than about 30 meV/atom at T=0K.

20. The superalloy composition of claim 1 further comprising a plurality of phases, the plurality of phases including a first phase that forms a substantially continuous matrix and a second phase that is a precipitate in the first phase, the first phase is different than the second phase; and one of the first phase or the second phase includes the at least one ternary intermetallic compound.

21. The superalloy composition of claim 20, wherein the second phase exhibits a crystal structure mismatch with the first phase that is about 0% to about 5%.

* * * * *